US010158159B2

(12) United States Patent
Kawamura

(10) Patent No.: US 10,158,159 B2
(45) Date of Patent: Dec. 18, 2018

(54) TRANSMISSION-LINE CONVERSION STRUCTURE FOR MILLIMETER-WAVE BAND

(71) Applicant: ANRITSU CORPORATION, Kanagawa (JP)

(72) Inventor: Takashi Kawamura, Kanagawa (JP)

(73) Assignee: ANRITSU CORPORATION, Kanagawa (JP)

( * ) Notice: Subject to any disclaimer, the term of this patent is extended or adjusted under 35 U.S.C. 154(b) by 7 days.

(21) Appl. No.: 15/880,951

(22) Filed: Jan. 26, 2018

(65) Prior Publication Data

US 2018/0151936 A1 May 31, 2018

Related U.S. Application Data

(62) Division of application No. 14/927,920, filed on Oct. 30, 2015.

(30) Foreign Application Priority Data

Oct. 31, 2014 (JP) ..... 2014-223567
Dec. 4, 2014 (JP) ..... 2014-245731

(51) Int. Cl.
*H01P 5/107* (2006.01)

(52) U.S. Cl.
CPC ..... *H01P 5/107* (2013.01)

(58) Field of Classification Search
CPC ..... H01P 5/107
USPC ..... 333/21 R, 26, 33, 34, 238, 239
See application file for complete search history.

(56) References Cited

U.S. PATENT DOCUMENTS 7,382,212 B2 6/2008 Lo Hine Tong et al.

FOREIGN PATENT DOCUMENTS

| | | | |
|---|---|---|---|
| DE | 69835633 | T2 | 8/2007 |
| DE | 60224012 | T2 | 11/2008 |
| JP | H05-83014 | A | 4/1993 |
| JP | 2008-079085 | A | 4/2008 |

OTHER PUBLICATIONS

Hyvonen, Lassi, et al., "A Compact MMIC-Compatible Microstrip to Waveguide Transition" In: IEEE MTT-S Digest; Jun. 1996, pp. 875-878.

(Continued)

*Primary Examiner* — Benny Lee
*Assistant Examiner* — Hafizur Rahman
(74) *Attorney, Agent, or Firm* — Pearne & Gordon LLP

(57) ABSTRACT

To provide a transmission-line conversion structure for a millimeter-wave band capable of being easily manufactured with a small size without easily causing non-uniformity in characteristics in a wide band. A transmission-line conversion structure for a millimeter-wave band that connects a microstrip line (10), which includes a main conductor (12) formed on one surface of a dielectric substrate (11) and a ground conductor (13) formed on the other surface thereof, with a waveguide (20) has a waveguide structure in which a transmission line (31) having a predetermined length is formed so as to be surrounded by metal walls (32). The transmission line is filled with a dielectric material having a relative permittivity of greater than 1. The transmission-line conversion structure allows electronic waves of a millimeter-wave band in a longitudinal direction of the main conductor.

12 Claims, 16 Drawing Sheets

(56) References Cited

OTHER PUBLICATIONS

Itakura, Kiyoyasu, et al. "Super High Frequency Circuit", Published by Ohmsha, Ltd. Feb. 25, 1963.
Sano, et al., "A Transition from Microstrip to Dielectric-Filled Rectangular Waveguide in Surface Mounting", IEEE Microwave Theory and Techniques—Symposium Digest 2002, pp. 813-816.
Zhang, Yunchi, et al. "A Waveguide to Microstrip Inline Transition With Very Simple Modular Assembly" In: IEEE Microwave and Wireless Components Letters; Sep. 2012, vol. 20, Issue 9, pp. 484-492.

E : Direction of Electric Field

TRANSMISSION-LINE CONVERSION STRUCTURE FOR MILLIMETER-WAVE BAND

CROSS-REFERENCE TO RELATED APPLICATIONS

This application is a divisional of application Ser. No. 14/927,920 filed on Oct. 30, 2015, which has been approved as a U.S. Pat. No. 10,044,088 issued on Aug. 7, 2018, the entire content of which is hereby incorporated by reference herein. This application also claims priority to Japanese Patent Application No. 2014-223567, filed Oct. 31, 2014, and to Japanese Patent Application No. 2014-245731, filed Dec. 4, 2014.

TECHNICAL FIELD

The present invention relates to a transmission-line conversion structure for allowing a signal of a millimeter-wave band to efficiently propagate between a microstrip line and a waveguide.

BACKGROUND ART

In a measurement instrument that measures a signal having a high frequency as in a millimeter-wave band, a waveguide having a low loss in the millimeter-wave band is used as an input or output transmission line in many cases. In such a measurement instrument, when characteristics of an integrated circuit (IC) are evaluated, it is necessary to connect a strip line (a microstrip line or a coplanar line) formed on a printed board on which an IC to be tested is mounted with a waveguide of the measurement instrument. However, the impedance of the strip line is generally about 50 to 100Ω, whereas the impedance of the waveguide is several hundreds of Ω. For this reason, it is not easy to achieve impedance matching.

As a technology of solving such a problem, there has been known a method of bringing a coupling ridge portion of a ridge waveguide into contact with a microstrip line as in Patent Document 1 or a method of vertically inserting a microstrip line from a side surface of a waveguide as in Patent Document 2.

RELATED ART DOCUMENT

Patent Document

[Patent Document 1] JP-A-5-83014
[Patent Document 2] JP-A-2008-79085

DISCLOSURE OF THE INVENTION

Problem that the Invention is to Solve

However, in the method of Patent Document 1, there are problems that it is difficult to manufacture the conversion structure since the ridge portion is narrowed in a high frequency and the degree of assembling difficulty becomes high since accuracy necessary to bring the ridge portion into contact with the microstrip line increases.

When there are many signal terminals on the IC to be measured, the respective strip lines that connect these terminals are necessarily formed on a mount board in a radial pattern. However, in the method of Patent Document since the front ends of the strip lines are inserted from the side surface of the waveguide, it is necessary to arrange many waveguides so as to be perpendicular to the rear ends of the respective strip lines, and thus, it is extremely difficult to manufacture the conversion structure. When bends are provided in the middle portions of the waveguides in order to avoid such a problem, there is a problem that the entire system becomes large. It has been known that non-uniformity in characteristics is caused due to the position of the strip line within the waveguide.

An object of the present invention is to provide a transmission-line conversion structure for a millimeter-wave band capable of solving such problems and being easily manufactured with a small size without easily causing non-uniformity in characteristics in a wide band.

Means for Solving the Problem

In order to achieve the object, according to a first aspect of the present invention, there is provided a transmission-line conversion structure for a millimeter-wave band that connects a microstrip line, which includes a main conductor formed on one surface of a dielectric substrate and a ground conductor formed on the other surface thereof and allows electronic waves of a millimeter-wave band to propagate in a longitudinal direction of the main conductor, with a waveguide which allows the electromagnetic waves of the millimeter-wave band to propagate. The transmission-line conversion structure has a waveguide structure in which a transmission line having a predetermined length is formed so as to be surrounded by metal walls, the transmission line is filled with a dielectric material having relative permittivity of greater than 1, one end surface of the transmission line is bonded to an end surface of the dielectric substrate of the microstrip line, and the other end surface of the transmission line is bonded to an aperture of the waveguide.

According to a second aspect of the present invention, in transmission-line conversion structure for a millimeter-wave band according to the first aspect, the dielectric material filling the transmission line may include a plurality M of dielectric layers having different relative permittivities, and may be formed so as to be continuously connected from one end of the transmission line to the other end thereof.

According to a third aspect of the present invention, in transmission-line conversion structure for a millimeter-wave band according to the first aspect, the transmission-line conversion structure may be formed between the microstrip line and one end of the transmission line and between the other end of the transmission line and one end of the waveguide so as to allow the electromagnetic waves of the millimeter-wave band to propagate.

According to a fourth aspect of the present invention, in transmission-line conversion structure for a millimeter-wave band according to the second aspect, the transmission-line conversion structure may be formed between the microstrip line and one end of the transmission line and between the other end of the transmission line and one end of the waveguide so as to allow the electromagnetic waves of the millimeter-wave band to propagate.

According to a fifth aspect of the present invention, in transmission-line conversion structure for a millimeter-wave band according to the third aspect, a size of the transmission line filled with the dielectric material and relative permittivities of the dielectric material filling the transmission line may be set such that a length of the transmission line filled with the dielectric material is a quarter of a guide wavelength of a desired propagation frequency and an impedance $Z_x$ of the transmission line filled with the dielectric material with respect to an impedance $Z_1$ of the microstrip line and an impedance $Z_2$ of the waveguide is represented by $Z_x=\sqrt{(Z_1\times Z_2)}$.

According to a fourth aspect of the present invention, in transmission-line conversion structure for a millimeter-wave band according to the fourth aspect, when combined impedances of the transmission line with respect to electromagnetic waves having a plurality N (≥M) of different frequencies $f_1$, $f_2$, . . . , and $f_N$ in a desired propagation frequency band are $Z_{x1}$, $Z_{x2}$, . . . , and $Z_{xN}$, impedances of the waveguide is $Z_{w1}$, $Z_{w2}$, . . . , and $Z_{wN}$, and an impedance Z1 of the microstrip line is Z1, the relationships of $Z_{x1}=\sqrt{(Z_1\times Z_{w1})}$, $Z_{x2}=\sqrt{(Z_1\times Z_{w2})}$, . . . , and $Z_{xN}=\sqrt{(Z_1\times Z_{wN})}$ may be satisfied. When the M number of frequencies among frequencies of the plurality N of frequencies $f_1$, $f_2$, . . . , and $f_N$ are $f_{a1}$ to $f_{aM}$, a guide wavelength when the electromagnetic wave having the first frequency $f_{a1}$ propagates through a first dielectric layer of the plurality of dielectric layers is $\lambda_{g1}$, a guide wavelength when the electromagnetic wave having the second frequency $f_{a2}$ propagates through a second dielectric layer of the plurality of dielectric layers is $\lambda_{a2}$, . . . , and a guide wavelength when the electromagnetic wave having the M-th frequency $f_{aM}$ propagates through a M-th dielectric layer of the plurality of dielectric layers is $\lambda_{gM}$, a sectional size of the transmission line and relative permittivities of the respective dielectric layers may be set such that a length L of the transmission line is represented by $L=\lambda_{g1}/4=\lambda_{g2}/4=\ldots,=\lambda_{gM}/4$.

According to a seventh aspect of the present invention, in transmission-line conversion structure for a millimeter-wave band according to the second aspect the M may be 2, a first dielectric layer may be a dielectric material having a relative permittivity of greater than 1, and a second dielectric layer may be an air layer having a relative permittivity of 1.

According to an eighth aspect of the present invention, in transmission-line conversion structure for a millimeter-wave band according to the sixth aspect, the M may be 2, the first dielectric layer may be a dielectric material having a relative permittivity of greater than 1, and the second dielectric layer may be an air layer having a relative permittivity of 1.

According to a ninth aspect of the present invention, the transmission-line conversion structure for a millimeter-wave band according to the third aspect may further include: a radiation wave guide that forms a radiation wave guide path which surrounds one end of the main conductor of the microstrip line by using metal walls at a predetermined length and guides radiation waves radiated to an external space from a boundary between the microstrip line and a transmission line on which the dielectric material is filled toward the other end of the main conductor; and a groove that is formed in an inner circumference of the metal walls of the radiation wave guide so as to have a depth corresponding to a quarter of a wavelength of the desired propagation frequency in order to prevent the leakage of the radiation waves.

According to a tenth aspect of the present invention, the transmission-line conversion structure for a millimeter-wave band according to the fourth aspect may further include: a radiation wave guide that forms a radiation wave guide path which surrounds one end of the main conductor of the microstrip line by using metal walls at a predetermined length and guides radiation waves radiated to an external space from a boundary between the microstrip line and the transmission line on which the plurality of dielectric layers is formed toward the other end of the main conductor; and a groove that is formed in an inner circumference of the metal walls of the radiation wave guide so as to have a depth corresponding to a quarter of a wavelength of the desired propagation frequency in order to prevent the leakage of the radiation waves.

According to a eleventh aspect of the present invention, the transmission-line conversion structure for a millimeter-wave band according to the sixth aspect may further include: a radiation wave guide that forms a radiation wave guide path which surrounds one end of the main conductor of the microstrip line by using metal walls at a predetermined length and guides radiation waves radiated to an external space from a boundary between the microstrip line and the transmission line on which the plurality of dielectric layers is formed toward the other end of the main conductor; and a groove that is formed in an inner circumference of the metal walls of the radiation wave guide so as to have a depth corresponding to a quarter of a wavelength of the desired propagation frequency in order to prevent the leakage of the radiation waves.

According to a twelfth aspect of the present invention, the transmission-line conversion structure for a millimeter-wave band according to the eighth aspect may further include: a radiation wave guide that forms a radiation wave guide path which surrounds one end of the main conductor of the microstrip line by using metal walls at a predetermined length and guides radiation waves radiated to an external space from a boundary between the microstrip line and the transmission line on which the plurality of dielectric layers is formed toward the other end of the main conductor; and a groove that is formed in an inner circumference of the metal walls of the radiation wave guide so as to have a depth corresponding to a quarter of a wavelength of the desired propagation frequency in order to prevent the leakage of the radiation waves.

According to a thirteenth aspect of the present invention, in transmission-line conversion structure for a millimeter-wave band according to the first aspect, metal posts that connect ground conductors formed on both surfaces of a dielectric substrate through through-hole processing may be formed in a part of the metal walls that surround the transmission line in rows with a predetermined distance.

According to a fourteenth aspect of the present invention, in transmission-line conversion structure for a millimeter-wave band according to the second aspect, metal posts that connect ground conductors formed on both surfaces of a dielectric substrate through through-hole processing may be formed in a part of the metal walls that surround the transmission line in rows with a predetermined distance.

According to a fifteenth aspect of the present invention, in transmission-line conversion structure for a millimeter-wave band according to the first aspect, a sectional size of one end of the waveguide bonded to the other end of the transmission line may be set to a size corresponding to a section size of a transmission line on which the dielectric material is filled, and the section size of the transmission line may increase toward the other end of the waveguide.

According to a sixteenth aspect of the present invention, in transmission-line conversion structure for a millimeter-wave band according to the second aspect, a sectional size of one end of the waveguide bonded to the other end of the transmission line may be set to a size corresponding to a section size of the transmission line on which the plurality of dielectric layers is formed, and the section size of the transmission line may increase toward the other end of the waveguide.

According to a seventeenth aspect of the present invention, in transmission-line conversion structure for a millimeter-wave band according to the ninth aspect, a sectional size of one end of the waveguide bonded to the other end of the transmission line is set to a size corresponding to a section size of a transmission line on which the dielectric material is filled, and the section size of the transmission line may increase toward the other end of the waveguide.

According to a eighteenth aspect of the present invention, in transmission-line conversion structure for a millimeter-wave band according to the eleventh aspect, a sectional size of one end of the waveguide bonded to the other end of the transmission line may be set to a size corresponding to a section size of the transmission line on which the plurality of dielectric layers is formed, and the section size of the transmission line may increase toward the other end of the waveguide.

According to a nineteenth aspect of the present invention, there is provided a transmission-line conversion structure for a millimeter-wave band that connects a microstrip line, which includes a main conductor formed on one surface of a dielectric substrate and a ground conductor formed on the other surface thereof and allows electronic waves of a millimeter-wave band to propagate in a longitudinal direction of the main conductor, with a waveguide which allows the electromagnetic waves of the millimeter-wave band to propagate. The transmission-line conversion structure may have a waveguide structure in which a transmission line having a predetermined length is formed so as to be surrounded by metal walls, the dielectric substrate may be inserted from one end surface of the transmission line such that the transmission line is filled with a dielectric material having a relative permittivity of greater than 1, and the other end surface of the transmission line may be bonded to an aperture of the waveguide.

According a twentieth aspect of the present invention, in transmission-line conversion structure for a millimeter-wave band according to the nineteenth aspect, the dielectric material filling the transmission line may include a plurality M of dielectric layers having different relative permittivities, and is formed so as to be continuously connected from one end of the transmission line to the other end thereof.

Advantage of the Invention

With such a configuration, in the transmission-line conversion structure for a millimeter-wave band of the present invention, since the electromagnetic waves of the millimeter-wave band are allowed to propagate between one end of the transmission line and the microstrip line and between the other end of the transmission line and the waveguide by using the waveguide structure having the transmission line in which the dielectric material is filled or the plurality of dielectric layers having different relative permittivities is formed from one end thereof to the other end, it is possible to provide a transmission-line conversion structure capable of connecting the microstrip line with the waveguide in a straight line and being easily manufactured with a small size without causing non-uniformity in characteristics.

Further, since a size of the transmission line filled with the dielectric material and relative permittivities of the dielectric material filling the transmission line are set such that a length of the transmission line filled with the dielectric material is a quarter of a guide wavelength of a desired propagation frequency and an impedance $Z_x$ of the transmission line filled with the dielectric material with respect to an impedance $Z_1$ of the microstrip line and an impedance $Z_2$ of the waveguide is represented by $Z_x=\sqrt{(Z_1\times Z_2)}$, it is possible to allow the electromagnetic waves to efficiently propagate through various microstrip lines and waveguides in a matching state, and thus, it is possible to realize high general versatility and wideband performance.

Further, since the sectional size of the transmission line and the relative permittivities of the dielectric layers are set such that the combined impedance $Z_{xi}$ of the transmission line including the plurality of dielectric layers in the plurality N of different frequencies in the desired propagation frequency band with respect to the impedance $Z_1$ of the microstrip line and the impedance $Z_{wi}$ of the waveguide is represented by $Z_{xi}=\sqrt{(Z_1\times Z_{wi})}$ (i=1 to N) and a quarter of the guide wavelength when the electromagnetic waves propagate through the respective dielectric layers in M number of frequencies is equal to the length of the transmission line, it is possible to allow the electromagnetic waves to efficiently propagate through various microstrip lines and waveguides in a wide band in a matching state, and thus, it is possible to realize high general versatility and wideband performance.

Further, since the number M of electromagnetic layers is 2, the dielectric material having the relative permittivity of greater than 1 is used as the first dielectric layer, and the air layer having the relative permittivity of 1 is used as the second dielectric layer, it is possible to achieve the simplest configuration, and it is possible to achieving wideband matching by selecting two different frequencies.

Further, since the radiation wave guide that forms the radiation wave guide path which surrounds one end of the main conductor by using the metal walls at the predetermined length and guides the radiation waves radiated to the external space from the boundary between the microstrip line and the transmission line on which the dielectric layers are formed toward the other end of the main conductor, and the groove that is formed in the inner circumference of the metal walls of the radiation wave guide so as to have a depth corresponding to a quarter of the wavelength of the desired propagation frequency in order to prevent the leakage of the radiation waves are provided, it is possible to prevent the leakage of the electromagnetic waves radiated to the external space from the boundary between the microstrip line and the transmission line on which the dielectric layers are formed.

Further, when the metal posts that connect the ground conductors formed on both surfaces of the dielectric substrate through through-hole processing are formed in a part of the metal walls that surround the transmission line on which the dielectric layers are formed in rows with the predetermined distance, it is possible to simply form the transmission line with a narrow width, and it is possible to more easily manufacture the conversion structure.

Further, when one of the plurality of dielectric layers is used by extending the dielectric substrate of the microstrip line, it is possible to integrally form the conversion structure with one end of the microstrip line, and it is possible to further simplify the structure.

Further, since the sectional size of one end of the waveguide is set to the size corresponding to the sectional size of the other end of the transmission line on which the dielectric layers are formed and the sectional size of the transmission line increases toward the other end of the waveguide, it is possible to suppress the reflection between the transmission line on which the dielectric layers are formed and the waveguide, and it is possible to easily connect the transmission line to the waveguide having the standard sectional size used in the millimeter-wave band.

BEST MODE FOR CARRYING OUT THE INVENTION

Hereinafter, embodiments of the present invention will be described with reference to the drawings.

Figure 1:
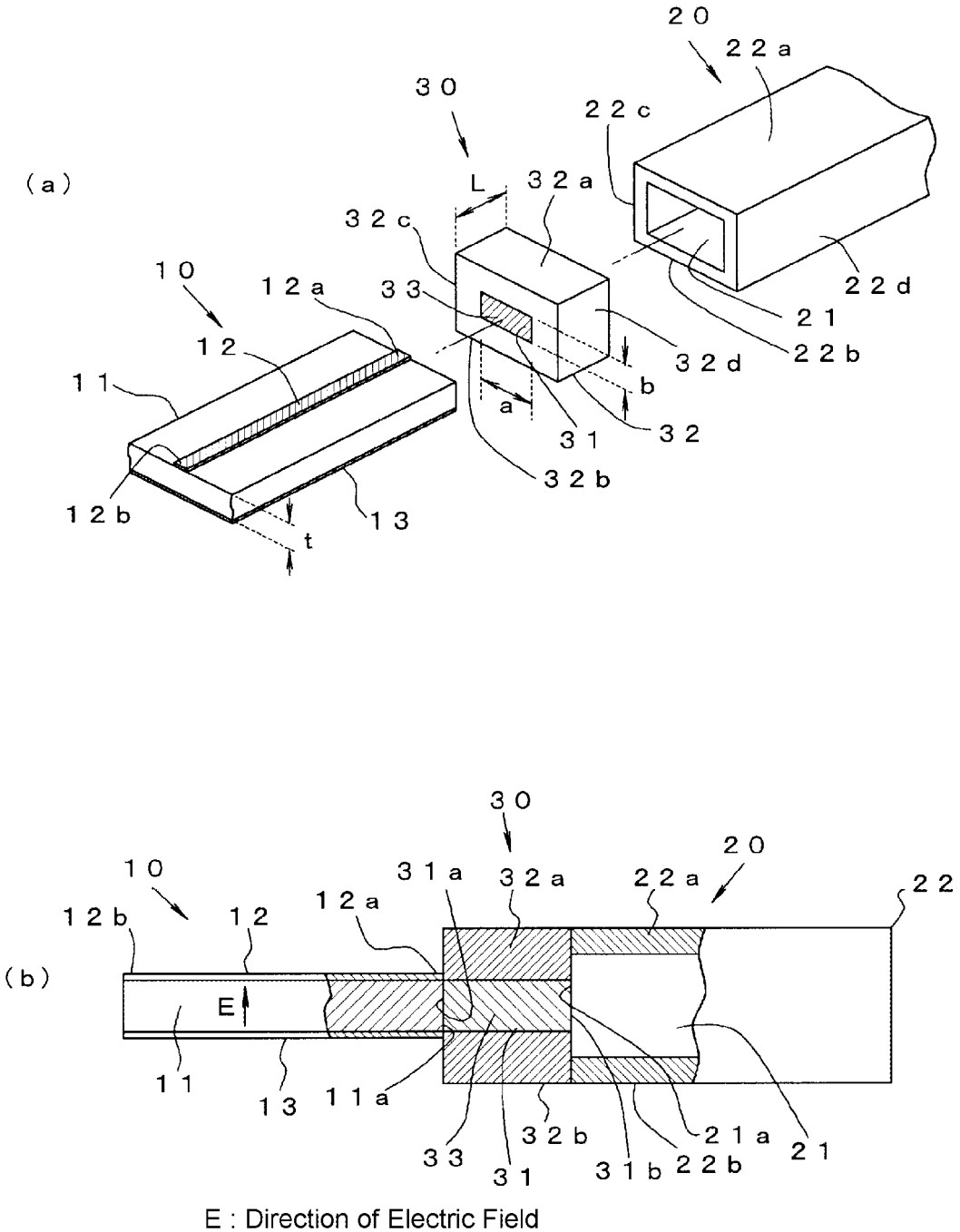
FIGS. 1(*a*)-1(*b*) is are diagrams showing a conversion structures which is an underlying technology of the present invention.

FIGS. 1(*a*) & 1(*b*) are diagrams showing a basic structure of the present invention. (a) of FIG. 1 is an exploded view showing a case where a microstrip line 10 capable of transmitting electromagnetic waves of a millimeter-wave band (for example, 60 to 90 GHz), a waveguide 20, and a transmission line converter 30 are provided as separate members, and (b) of FIG. 1 is a side sectional view showing a connected state thereof.

The microstrip line 10 is formed such that a strip-shaped main conductor 12 is patterned on one surface of a dielectric substrate 11 from one end to the other end, the other surface is covered with a ground conductor 13, and the impedance of the transmission line is determined by a thickness t and a permittivity $\varepsilon_r'$ of the dielectric substrate 11 and a width of the main conductor 12. The impedance is about 50Ω to 100Ω which are generally used in high-frequency circuits. For example, as a dielectric substrate having a low loss in the millimeter-wave band, there is a Ro4003C (registered trade mark) having a relative permittivity $\varepsilon_r'$ of 3.55 and a thickness t of 0.3 mm.

The waveguide 20 is a square waveguide having sectional size determined by a standard in consideration of general versatility. As the waveguide, a WR-12 waveguide (sectional size of about 3.1×1.55 mm) which is generally used in the frequency band is used. The impedance of the waveguide 20 is changed depending on a frequency, and is, for example, 552Ω in a frequency of 75 GHz. As mentioned previously, the dielectric substrate 11 of the microstrip line 10 has a thickness t on the order of 1/10 millimeters, whereas the waveguide 20 has a sectional size on the order of millimeters. For this reason, reflection due to a difference between the sectional sizes of the transmission lines poses a problem, but the problem about the reflection will be described below.

The transmission line converter 30 that connects the microstrip line 10 and the waveguide 20 has a waveguide structure in which a transmission line 31 having a predetermined sectional size (a×b mm) is formed so as to be surrounded by metal walls 32 at a predetermined length, the transmission line 31 is filled with a dielectric material 33 having a relative permittivity $\varepsilon_r$ of greater than 1. Here, although it will be described that a height b of the transmission line 31 (the thickness of the dielectric material 33) is equal to the thickness t of the dielectric substrate 11 of the microstrip line 10, the thicknesses of the dielectric material and the dielectric substrate may be different.

One end surface 31*a* of the transmission line 31 is bonded to an end surface 11*a* of the dielectric substrate 11 at one end of the main conductor 12 of the microstrip line 10. Of metal walls 32*a* and 32*b* that face each other on one side of the transmission line 31, an end surface of the upper metal wall 32*a* is connected to one end 12*a* of the main conductor 12 of the microstrip line 10, and an end surface of the lower metal wall 32*b* is connected to the around conductor 13. The other end surface 31*b* of the transmission line 31 is bonded to an aperture 21*a* of one end of a transmission line 21 of the waveguide 20. End surfaces of four metal walls 32*a* to 32*d* are bonded to one ends of metal walls 22 (22*a* to 22*d*) that surround the transmission line 21 of the waveguide 20 on the entire circumference on the other side of the transmission line 31.

As stated above, in the connection structure in which the microstrip line 10 and the waveguide 20 are coaxially connected through the transmission line 31 filled with the dielectric material 33, the electromagnetic waves of the millimeter-wave band, which have been input from the other end 12*b* of the main conductor 12 of the microstrip line 10 and has propagated to the one end 12*a*, are input to one end of the transmission line 31, propagate through the transmission line 31, and are output to the transmission line 21 of the waveguide 20 from the other end. Accordingly, it is possible to obtain a transmission-line conversion structure for a millimeter-wave band capable of being easily manufactured with a small size without easily causing non-uniformity in characteristics.

The sectional size a×b of the transmission line 31 and the relative permittivity $\varepsilon_r$ of the dielectric material 33 are set such that a length L of the transmission line 31 is a quarter of a guide wavelength $\lambda_g$ of an electromagnetic wave having a desired propagation frequency $f_1$ and an impedance $Z_x$ of the transmission line 31 filled with the dielectric material 33 with respect to an impedance $Z_1$ (regarded as being constant with respect to the frequency) of the microstrip line 10 and an impedance $Z_2$ of the waveguide 20 is represented as $Z_x=\sqrt{(Z_1\times Z_2)}$.

Thus, the transmission line converter 30 includes a ¼-wavelength transformer, and thus, it is possible to connect the microstrip line 10 to the waveguide 20 in a matching state.

Next, the impedance of the transmission line converter 30 having the conversion structure will be examined. If the transmission line is in a vacuum state, an impedance $Z_x'$ of a TE wave transmitted in the transmission line 31 of the transmission line converter 30 is represented by the following expression.

$$Zx' = \frac{\mu_0/\varepsilon_0}{\sqrt{1-(\lambda/\lambda_c)^2}} = \frac{120\pi}{\sqrt{1-(\lambda/\lambda_c)^2}} \quad (1)$$

where $\mu_0$ is the permeability of vacuum, $\varepsilon_0$ is the permittivity of vacuum, $\lambda$ is a free-space wavelength, and $\lambda_c$ is a cut-off frequency.

By contrast, the impedance $Z_x$ when the transmission line 31 is filled with the dielectric material 33 having a relative permittivity $\varepsilon_r$ is represented by the following expression.

$$Zx = \frac{\mu_0/(\varepsilon_0 \cdot \varepsilon_r)}{\sqrt{1-(\lambda/\lambda_c)^2}} = \frac{120\pi}{\varepsilon_r\sqrt{1-(\lambda/\lambda_c)^2}} \quad (2)$$

A cut-off frequency $\lambda_{c10}$ of a TE10 mode (single mode) is represented by the following expression in consideration of the fact that the dielectric material 33 is filled.

$$\lambda_{c10}=2a\sqrt{\varepsilon_r} \quad (3)$$

The following expression obtained by substituting Expression (3) for Expression (2).

$$Zx = \frac{120\pi}{\varepsilon_r\sqrt{1-(\lambda/\lambda_{c10})^2}} = \frac{120\pi}{\varepsilon_r\sqrt{1-(\lambda/2a\sqrt{\varepsilon_r})^2}} \quad (4)$$

It can be seen from the above that it is possible to control the impedance of the transmission line converter 30 by using the relative permittivity $\varepsilon_r$ of the dielectric material 33 and a width a of the transmission line 31 filled with the dielectric material 33. Although not described in detail, a height b of the transmission line 31 (the thickness of the dielectric material 33) may not be considered.

The guide wavelength $\lambda_g$ of the transmission line converter 30 is represented by the following expression.

$$\lambda_g = \frac{\lambda}{\sqrt{1-(\lambda/\lambda_c)^2}} \quad (5)$$

The transmission line converter 30 can act as the ¼-wavelength transformer by setting the length L of the transmission line 31 to be $\lambda_g/4$.

In the basic structure, the calculation of the transmission line converter 30 for matching the microstrip line 10 which uses Ro4003C (registered trade mark) having a relative permittivity $\varepsilon_r'$ of 3.55 and a thickness of 0.3 mm as the dielectric substrate 11 and has an impedance $Z_1$ of 100Ω with a WR-12 type waveguide (a usage band of 60 to 90 GHz) in a frequency of 75 GHz is performed. Here, the relative permittivity $\varepsilon_r$ and the thickness b of the dielectric material 33 are the same as those of the dielectric substrate 11 of the microstrip line 10.

The impedance $Z_1$ of the microstrip line 10 is 100Ω, the impedance $Z_2$ of the waveguide 20 is 552Ω (75 GHz) from Expression (1), and the impedance $Z_x$ required for the transmission line converter 30 is 235Ω from $Z_x=\sqrt{(Z_1 \times Z_2)}$.

The width a of the dielectric material that satisfies the impedance $Z_x$ of 235Ω is 2.7 mm, and a quarter of the guide wavelength $\lambda_g$ is 1.08 mm. That is, in order to match the microstrip line and the waveguide in 75 GHz, it can be seen that the width a of the transmission line 31 (the width of the dielectric material 33) is appropriately 2.7 mm and the length L is appropriately 1.08 mm.

For this reason, it can be seen that it is possible to effectively convert the transmission line between the microstrip line 10 and the waveguide 20 in a desired frequency (75 GHz) and surrounding frequencies by using the transmission line filled with the dielectric material 33 as described above.

In the case of the basic structure, since it is not possible to completely remove the radiation of the electromagnetic waves an external space due to the mismatching at the boundary between the microstrip line 10 and the transmission line converter 30 and the reflection thereof due to the mismatching at the boundary between the transmission line converter 30 and the waveguide 20, it is expected that characteristics will be degraded due to the radiation waves or the reflection waves to the external space.

Figure 2:
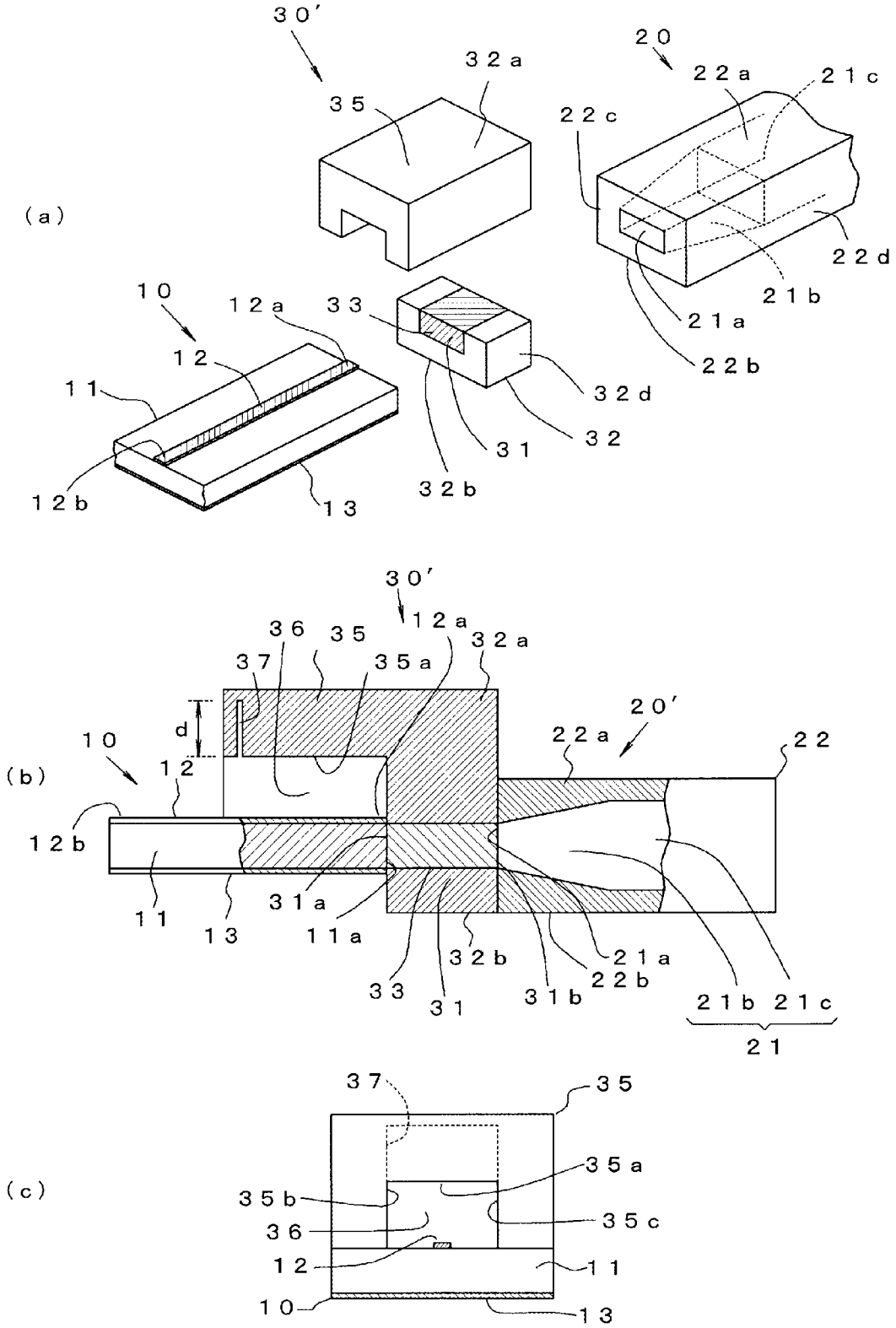
FIGS. 2(*a*)-2(*c*) are diagrams showing a structures in which radiation to a space is suppressed.

FIG. 2(*a*)-2(*c*) show examples of the transmission-line conversion structure in which the influence due to the radiation waves or the reflection waves is reduced. In a transmission line converter 30' of this structure example, of the metal walls 32*a* to 32*d* that surround the dielectric material 33, a radiation wave guide 35 is provided on an end surface of the upper metal wall 32*a* facing the microstrip line 10.

The radiation wave guide 35 is formed in a U shape of which the bottom is opened using a first metal wall 35*a* that faces the dielectric substrate 11 of the microstrip line 10 in parallel, and is separated from the main conductor 12 by a predetermined distance, a second metal wall 35*b* that is provided on one side of the main conductor 12 so as to be separated by a predetermined distance, and a third metal wall 35*c* that is provided on the other side of the main conductor 12. The radiation wave guide is provided with a radiation wave guide path 36 that surrounds one end of the main conductor 12 between the dielectric substrate 11 and the radiation wave guide at a predetermined length, controls the radiation of the electromagnetic waves to the external space from the boundary between the microstrip line 10 and the transmission line 31 filled with the dielectric material 33, and guides the electromagnetic waves radiated to the space toward the other end of the main conductor 12.

A groove 37 having a depth d corresponding to a quarter of a wavelength of a desired propagation frequency is formed in an inner circumference of the first metal wall 35*a* of the radiation wave guide 35 in a direction perpendicular to the longitudinal direction of the main conductor 12 in order to prevent the leakage of the electromagnetic waves radiated to the space. Since components incident on the groove 37 and components output from the groove 37 after reciprocation offset each other due to phase inversion, it is possible to prevent the leakage of the electromagnetic waves radiated to the space.

It is possible to prevent the leakage of the electromagnetic waves radiated to the external space due to the mismatching at the boundary between the microstrip line 10 and the transmission line 31 filled with the dielectric material 33 by using the groove 37 formed in the radiation wave guide 35. It has been described in this example that one groove 37 is illustrated, but it is possible to prevent the leakage of the electromagnetic waves radiated to the external space in a wider band by forming a plurality of grooves having different depths in rows in the longitudinal direction of the first metal wall 35*a*. It has been described in this example that the radiation wave guide 35 which includes three metal walls 35*a* to 35*c* and has the U shape of which the bottom is open is used. However, the radiation wave guide 35 may have a shape capable of allowing the metal walls to surround one end of the main conductor 12 at a predetermined length, controlling the radiation of the electromagnetic waves to the external space from the boundary between the microstrip line 10 and the transmission line 31 filled with the dielectric material 33, and guiding the radiation waves radiated to the external space toward the other end of the main conductor 12, or may have an inner section having a trapezoidal or semicircular shape. The groove 37 may be formed in the entire inner circumference at a predetermined depth in addition to a wall surface facing the dielectric substrate 11 of the microstrip line 10.

Meanwhile, the sectional size of the transmission line 31 filled with the dielectric material 33 is 2.7×0.3 mm as in the numerical value example, whereas the standard sectional size of the waveguide used in the millimeter-wave band is about 3.1×1.55 mm in the WR-12 type. The dimensions in the width directions thereof are close to each other, but the dimensions in the thickness directions thereof have a difference of five or more times, and thus, there may be a problem of the reflection due to a difference between the sectional sizes.

For this reason, as shown in FIG. 2, the reflection due to the difference between the sectional sizes of the waveguide 20 and the transmission line 31 filled with the dielectric material 33 is controlled by setting the sectional size of the aperture 21*a* at one end of the waveguide 20' to be the size (for example, 2.7×0.3 mm) which is less than the standard sectional size and corresponds to the sectional size of the other end of the transmission line 31 filled with the dielectric material 33 and forming a taper portion 21*b* of which the sectional size gradually (although the sectional size straightly increases in the drawing, the sectional size may stepwisely increase) increases (for example, up to the standard sectional size) toward the other end from the opening and a standard sectional size portion 21*c* that is continuously connected to the taper portion 21*b*.

Figure 3:
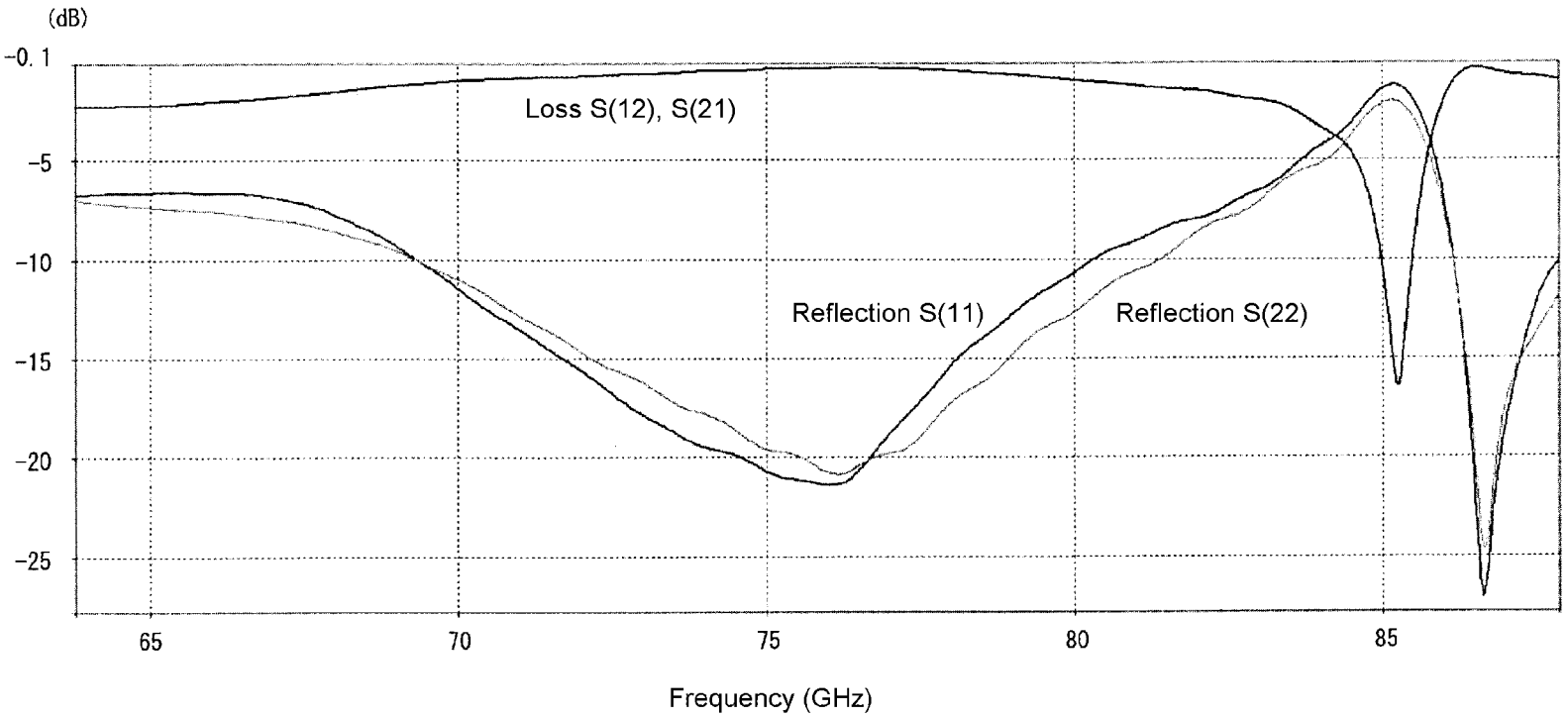
FIG. 3 is a diagram showing a simulation result of the structure of FIG. 2.

As described above, a simulation result in which transmission characteristics when the width a of the transmission line 31 filled with the dielectric material 33 is 2.7 mm and the length L is 1.08 mm are obtained in the transmission-line conversion structure is shown in FIG. 3.

It can be seen in FIG. 3 that an insertion loss is 1 dB or less and a reflection coefficient is −10 dB or less in a frequency range of 70 to 80 GHz and the matching is achieved near a desired propagation frequency of 75 GHz.

In the transmission-line conversion structure, the transmission line 31 filled with the dielectric material 33 is formed so as to be surrounded by the metal walls 32*a* to 32*d*, but any structure may be used.

Figure 4:
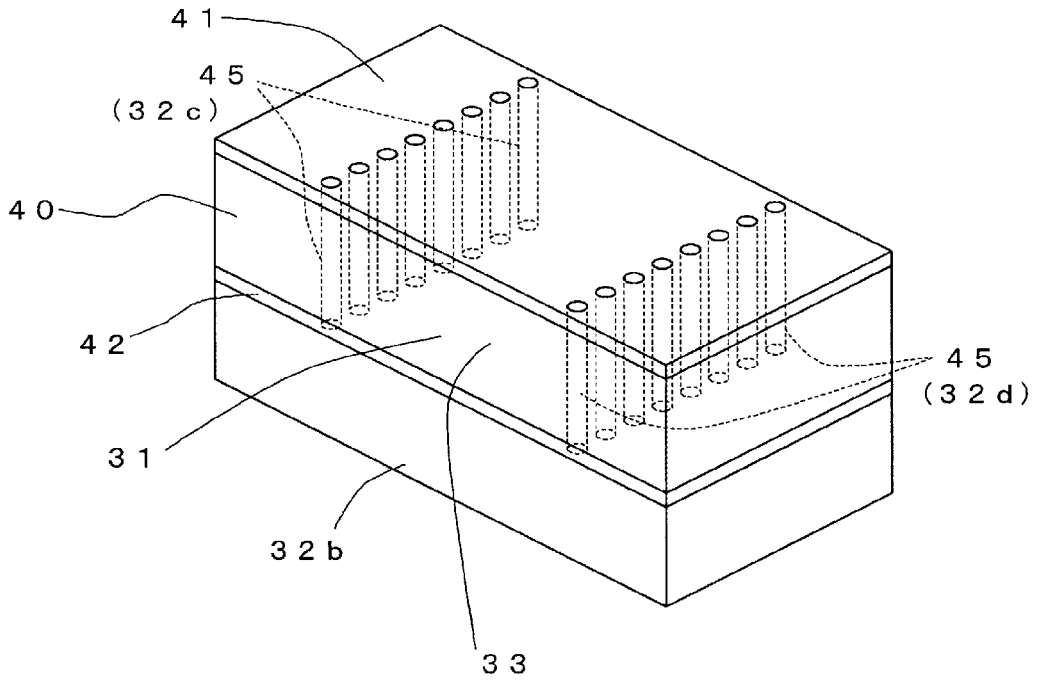
FIG. 4 is a diagram showing an example in which a metal wall that surrounds a transmission line is formed using metal posts.
Figure 5:
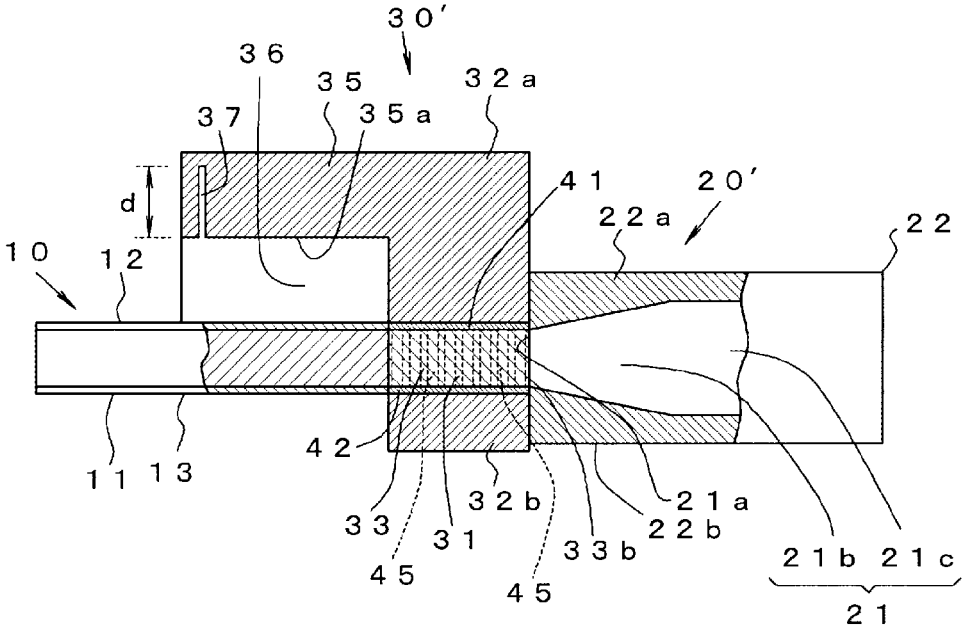
FIG. 5 is a diagram showing a structure using the transmission line of FIG. 4.

For example, as shown in FIG. 4, it is possible to form the metal walls 32*c* and 32*d* on both sides of the transmission line 31 filled with the dielectric material 33 by connecting ground conductors 41 and 42 that cover both surfaces of a dielectric substrate 40 similar to the dielectric substrate 11 used in the microstrip line 10 using metal posts 45 formed through through-hole processing and forming the metal posts 45 in two rows with a predetermined distance. In this case, a distance between the metal posts 45 within the row is sufficiently less than the wavelength of the electromagnetic waves propagating through the transmission line, and the distance between the rows is equal to the width a. FIG. 5 shows a transmission-line conversion structure in which the transmission line 31 filled with dielectric material 33 is formed using the metal posts 45, and in this case, the ground conductors 41 and 42 on the both surfaces of the dielectric substrate 40 are in contact with the metal walls 32*a* and 32*b*.

Since the thicknesses of the ground conductors 41 and 42 are generally small enough to be ignored compared with the thickness of the substrate, even though the central portion (portion between the rows of the metal posts 45) of the ground conductor 41 is removed, the metal wall 32*a* is in contact with the top of the ground conductor, and thus, there is no difficulty.

Figure 6:
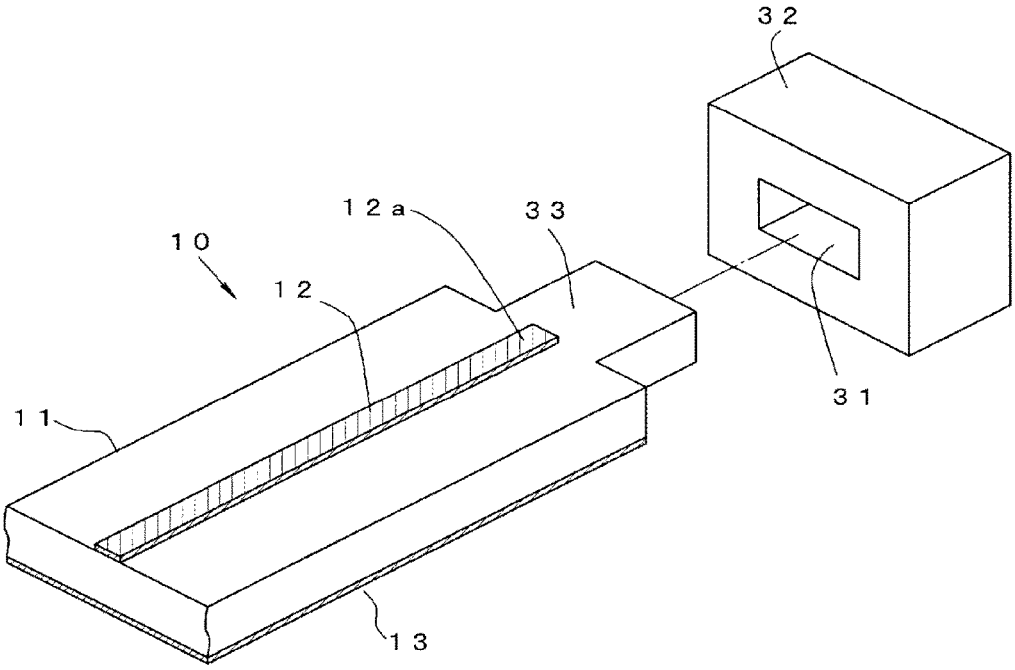
FIG. 6 is a diagram showing a structure example in which a dielectric material filling the transmission line is formed by extending a dielectric substrate of a microstrip line.
Figure 7:
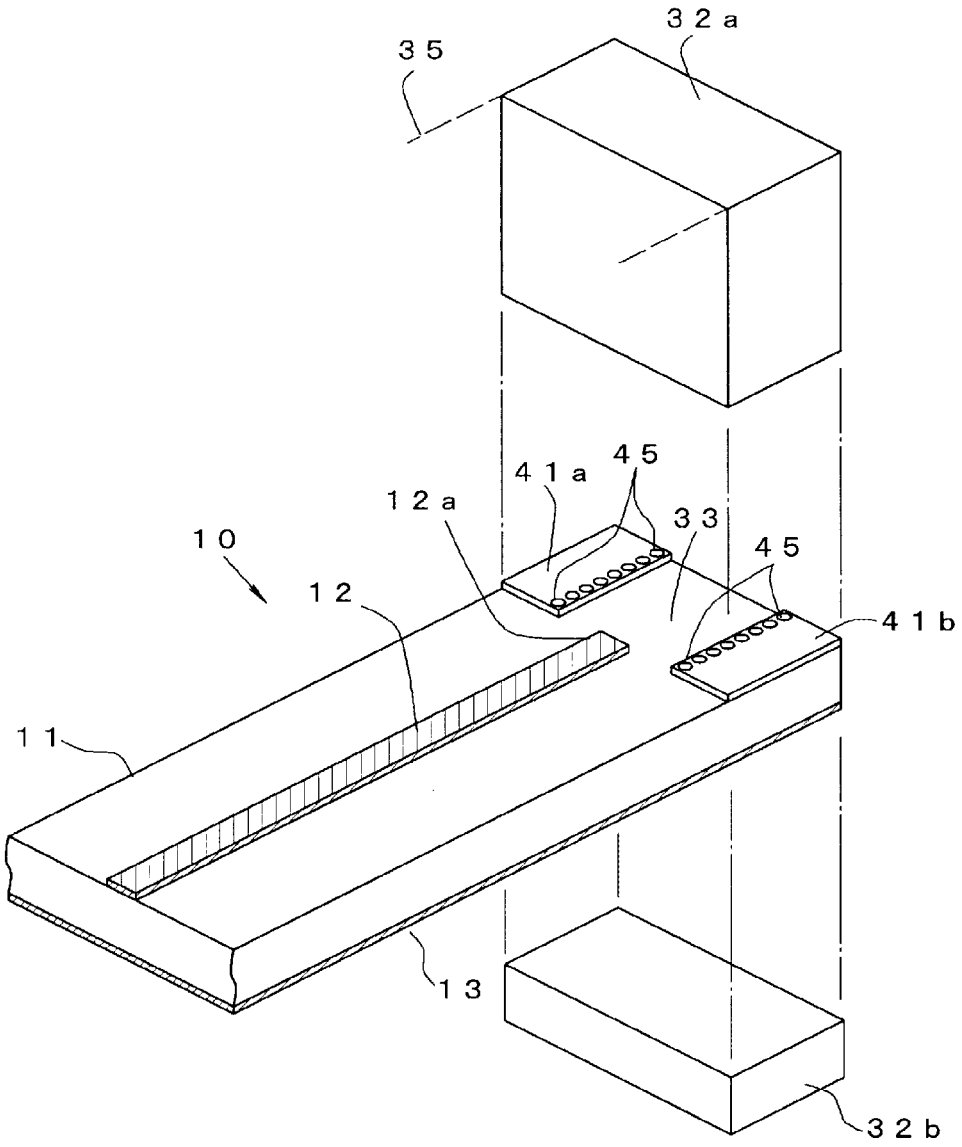
FIG. 7 is a diagram showing another structure example in which a dielectric material filling transmission line is formed by extending the dielectric substrate of the microstrip line.

Although it has been described in the respective embodiments that the transmission line converter 30 including the transmission line 31 filled with the dielectric material 33 is provided separately from the microstrip line 10 and the waveguide 20 or 20', the dielectric material 33 filling the transmission line 31 for transmission-line conversion may be formed by extending the end of the dielectric substrate 11 of the microstrip line 10, as shown in FIGS. 6 and 7. FIG. 6 shows a structure corresponding to the structure shown in FIGS. 1 and 2. FIG. 7 shows a structure corresponding to the structure using the metal posts 45 of FIGS. 4 and 5. In this case, the ground conductor is divided into two ground conductors 41*a* and 41*b* by removing the central portion of the ground conductor 41 of FIGS. 4 and 5, and the ground conductor 13 of the microstrip line 10 is also used as the ground conductor 42 of FIGS. 4 and 5.

Although not shown, it is possible to integrally form at least a part of the metal walls 32*a* to 32*d* constituting the transmission line 31 with the waveguide 20 or 20', and it is possible to variously modify the specific structure.

When the frequency range desired to be transmitted is wider, it is preferable that a plurality (M) of dielectric layers having different relative permittivities is formed within the transmission line. The sectional size of the transmission line 31 and the relative permittivities of the dielectric layers are set such that a combined impedance $Z_{xi}$ of the transmission line constructed by the plurality of dielectric layers with respect to the impedance $Z_1$ of the microstrip line 10 and the impedance $Z_{wi}$ of the waveguide 20 in a plurality N (≥M) of different frequencies in the desired propagation frequency band is represented by $Z_{x2}=\sqrt{(Z_1\times Z_{w1})}$ (i=1 to M) and a quarter of the guide wavelength when the electromagnetic waves propagate through the respective dielectric layers in M number of frequencies is equal to the length of the transmission line. Accordingly, it is possible to allow electromagnetic waves to efficiently propagate through various microstrip lines and waveguides in a wide band in a matching state, and thus, it is possible to realize high general versatility and wideband performance. It is assumed that the dielectric layer mentioned herein includes air having a relative permittivity of 1 (the relative permittivity of air is strictly greater than the permittivity of vacuum, but it is assumed in this example that the relative permittivity thereof is 1).

Figure 8:
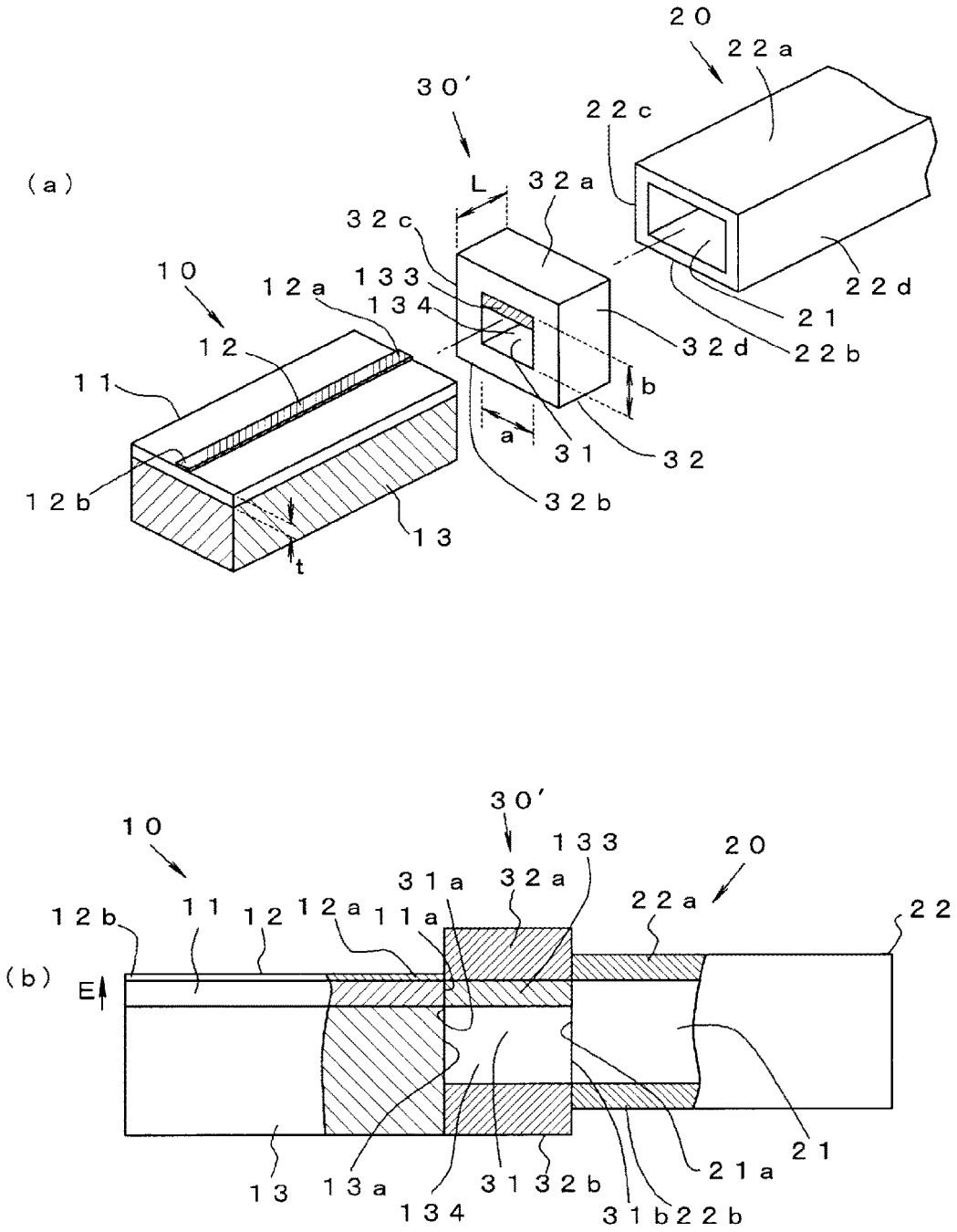
FIG. 8(*a*)-8(*b*) are diagrams showing a basic structure of the present invention.

FIGS. 8(*a*)-(*b*) show an example of the simplest basic structure of M=2, and a first dielectric layer 133 as an upper layer made of a dielectric material having a relative permittivity $\epsilon_{r1}$ of greater than 1 and a second dielectric layer 134 as a lower air layer having a relative permittivity of $\epsilon_{r2}$ are formed within the transmission line 31 of the transmission line converter 30' so as to be continuously connected from one end to the other end.

For example, it is assumed that the first dielectric layer 133 is made of the same material as the dielectric substrate 11 of the microstrip line 10 and has the same thickness as the dielectric substrate. The thickness of the second dielectric layer 134 is set so as to be equal to a difference between the height of the transmission line 21 of the waveguide 20 and the thickness of the first dielectric layer 133, and in this structure example, one end of the dielectric layer 134 is closed by the end surface 13*a* of the ground conductor 13 of the microstrip line 10.

In this structure, from Expression (3) above, the guide wavelength $\lambda_{g1}$ of the electromagnetic waves propagating through the second dielectric layer 134 as the air layer in a frequency $f_1$ in the desired frequency band is represented by the following expression based on the fact that the relative permittivity $\varepsilon_{r2}$ is 1.

$$\lambda_{g1} = \frac{\lambda}{\sqrt{1-(\lambda/2a)^2}} \tag{6}$$

Meanwhile, the guide wavelength $\lambda_{g2}$ of the electromagnetic waves propagating through the first dielectric layer 133 in another frequency $f_2$ (>f1) in the desired frequency band is represented by the following expression.

$$\lambda_{g2} = \frac{\lambda}{\sqrt{1-(\lambda/2a\sqrt{\varepsilon_{r1}})^2}} \tag{7}$$

Thus, if the width a of the transmission line 31 and the permittivities of the respective dielectric layers are set such that a quarter of the guide wavelength $\lambda_{g1}$ when the electromagnetic wave having the frequency $f_1$ propagate through the second dielectric layer 134 and a quarter of the guide wavelength $\lambda_{g2}$ when the electromagnetic wave having the frequency $f_2$ propagate through the first dielectric layer 133 are equal to the length L of the transmission line 31 (the lengths of the first dielectric layer 133 and the second dielectric layer 134) and the relationship between the impedances in the respective frequencies satisfies the aforementioned relationship, it is possible to achieve the matching in two different frequency ranges, it is possible to achieve the matching in the entire desired band by selecting the frequencies in a low band and a high band of the desired band, and it is possible to achieve wideband.

As in the aforementioned structure, if specific numerical value example of M=2 is represented, when four (N=4) different frequencies are $f_1$=60 GHz, $f_2$=70 GHz, $f_3$=80 GHz, and $f_4$=90 GHz and the impedance $Z_1$ of the microstrip line 10 is 100Ω, the impedance $Z_{w1}$ of the waveguide 20 in the frequency $f_1$ of 60 GHz is 1078χ, and the impedance $Z_x$ necessary to match with the microstrip line 10 is 328Ω. Here, the impedance when the width a of the transmission line 31 is 2.2 mm is 314Ω, and a matching condition is substantially satisfied. The impedance of 314Ω is originally the combined impedance of the first dielectric layer 133 with the second dielectric layer 134, but since the impedance of the second dielectric layer 134 as the air layer is sufficiently greater than the impedance of the first dielectric layer 133, the value of the impedance of the first dielectric layer 133 is used (the same applies later).

The impedance $Z_{w2}$ of the waveguide 20 in the frequency $f_2$ of 70 GHz is 721Ω, and the impedance $Z_x$ necessary to match with the microstrip line 10 is 268Ω. As described previously, the impedance when the width a of the transmission line 31 is 2.2 mm is 273Ω, and the matching condition is substantially satisfied.

The impedance $Z_{w3}$ of the waveguide 20 in the frequency $f_3$ of 80 GHz is 594Ω, and the impedance $Z_x$ necessary to match with the microstrip line 10 is 244Ω. As mentioned above, the impedance when the width a of the transmission line 31 is 2.2 mm is 252Ω, and the matching condition is substantially satisfied.

The impedance $Z_{w4}$ of the waveguide 20 in the frequency $f_4$ of 90 GHz is 530Ω, and the impedance $Z_x$ necessary to match with the microstrip line 10 is 230Ω. As mentioned above, the impedance when the width a of the transmission line 31 is 2.2 mm is 238Ω, and the matching condition is substantially satisfied.

Next, since the length L of the transmission line 31 is 1.252 mm which is a quarter of the guide wavelength when the electromagnetic waves propagate through the first dielectric layer 133 in the frequency $f_2$ of 70 GHz and is 1.277 mm which is a quarter of the guide wavelength when the electromagnetic waves propagate through the second dielectric layer 134 (air layer) in the frequency $f_4$ of 90 GHz, the length L of the transmission line 31 is set to be 1.26 mm between the both frequencies. Thus, it is possible to match the guide wavelengths in the both frequencies and the surrounding frequencies thereof. Here, although the guide wavelengths of the two dielectric layers in the frequency $f_2$ of 70 GHz and the frequency $f_4$ of 90 GHz match each other, the present invention is not limited thereto. A plurality of frequencies capable of covering a desired band may be selected, or a combination of the frequencies of 60 GHz and 90 GHz may be used. In the case of a three-layer structure, the frequencies of 60 GHz, 75 GHz and 90 GHz may be selected.

Although the structure example in which the plurality (M=2) of dielectric layers is provided within the transmission line 31 has been described in the aforementioned example, this example represented as follows by being generalized as M≥2.

That is, with regard to electromagnetic waves having a plurality N (≥M) of different frequencies $f_1$, $f_2$, . . . , and $f_N$ in a desired propagation frequency band of the millimeter-wave band, when the combined impedances of the transmission line 31 constructed by a plurality of dielectric layers are respectively $Z_{x1}$, $Z_{x2}$, . . . , and $Z_{xN}$, the impedances of the waveguide 20 are respectively $Z_{w1}$, $Z_{w2}$, . . . , and $Z_{wN}$, and the impedance of the microstrip line 10 is $Z_1$, the following relationships are satisfied.

$$Z_{x1}=\sqrt{(Z_1\times Z_{w1})}$$

$$Z_{x2}=\sqrt{(Z_1\times Z_{w2})}$$

. . .

$$Z_{xN}=\sqrt{(Z_1\times Z_{wN})}$$

When M number of frequencies of the plurality N of frequencies $f_1$, $f_2$, . . . , and $f_N$ are $f_{a1}$ to $f_{aM}$, the guide wavelength when the electromagnetic wave having the first frequency $f_{a1}$ propagates through the first dielectric layer of the plurality (M) of dielectric layers is $\lambda_{g1}$, the guide wavelength when the electromagnetic wave having the second frequency $f_{a2}$ propagates through the second dielectric layer of the plurality (M) of dielectric layers is $\lambda_{g2}$, . . . , and the guide wavelength when the electromagnetic wave having the M-th frequency $f_{aM}$ propagates through the M-th dielectric layer of the plurality (M) of dielectric layers is $\lambda_{gM}$, the sectional size of the transmission line 31 and the relative permittivities of the dielectric layers may be set such that the length L of the transmission line 31 is $L=\lambda_{g1}/4=\lambda_{g2}/4=\ldots=\lambda_{gM}/4$.

However, the actual relative permittivity of the dielectric material is unmistakably determined by a material, and it is not possible to use an arbitrary value. For this reason, it is necessary to set only the width a and the length L of the transmission line 31 such that the aforementioned condition is satisfied selecting a dielectric material having a low loss in the millimeter-wave band and using the relative permittivity thereof.

In the aforementioned basic structure, it is not possible to completely remove the radiation of the electromagnetic waves to the external space from the boundary between the microstrip line 10 and the transmission line converter 30 or the reflection at the boundary between the transmission line converter 30 and the waveguide 20, and thus, it is expected that the characteristics will be degraded due to the radiation waves or the reflection waves.

Figure 9:
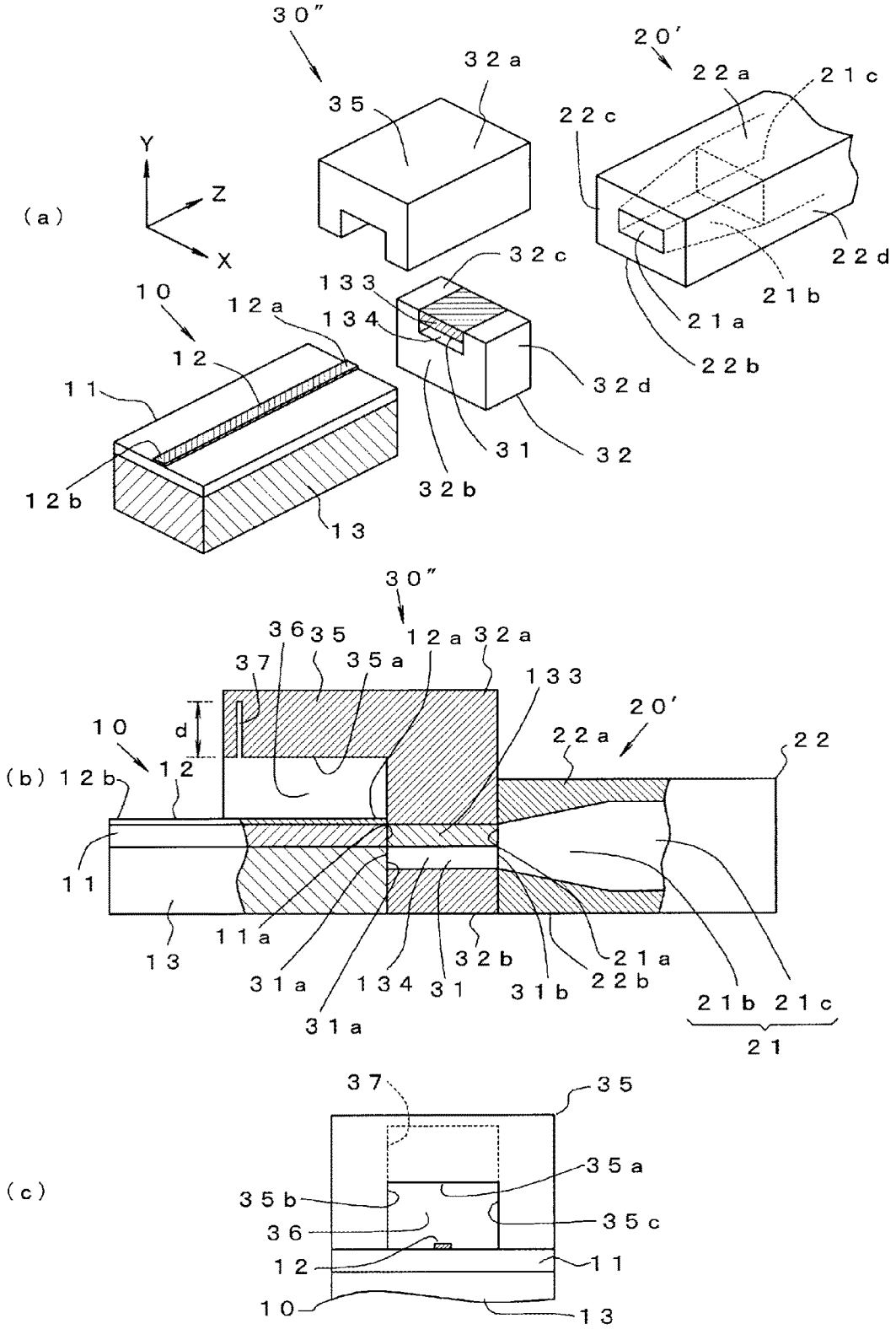
FIG. 9(*a*)-9(*c*) are diagrams showing a structures in which radiation is reduced.

FIGS. 9(*a*)-9(*c*) show examples of a more practical transmission-line conversion structure in which the influence due to the radiation waves and the reflection waves is reduced. In a transmission line converter 30" of this structure example, of the metal walls 32*a* to 32*d* that surround the dielectric material 33, the radiation wave guide 35 is provided on the end surface of the upper metal wall 32*a* facing the microstrip line 10.

The radiation wave guide 35 is formed in the U shape of which the bottom is open using the first metal wall 35*a* that faces the dielectric substrate 11 of the microstrip line 10 in parallel, and is separated from the main conductor 12 by the predetermined distance, the second metal wall 35*b* that is formed on one side of the main conductor 12 so as to be separated by the predetermined distance, and the third metal wall 35*c* that is formed on the other side of the main conductor 12 so as to be separated by the predetermined distance. The radiation wave guide is provided with the radiation wave guide path 36 that surrounds one end of the main conductor 12 between the dielectric substrate 11 and the radiation wave guide at a predetermined length, controls the radiation of the electromagnetic waves to the external space from the boundary between the microstrip line 10 and the transmission line 31, and guides the radiation waves toward the other end of the main conductor 12.

The groove 37 having the depth corresponding to a quarter of the wavelength of the desired propagation frequency is formed in the inner circumference of the first metal wall 35*a* of the radiation wave guide 35 in the direction perpendicular to the longitudinal direction of the main conductor 12 in order to prevent the leakage of the radiation waves. Since the components incident on the groove 37 and the components output from the groove 37 after reciprocation offset each other due to phase inversion, it is possible to prevent the leakage of the radiation waves.

It is possible to prevent the leakage of the electromagnetic waves radiated from the boundary between the microstrip line 10 and the transmission line 31 by using the groove 37 formed in the radiation wave guide 35.

It has been described in this example that one groove 37 is illustrated, but it is possible to prevent the leakage of the electromagnetic waves radiated to the external space in a wider band by forming a plurality of grooves having different depths in rows in the longitudinal direction of the first metal wall 35*a*. It has been described in this example that the radiation wave guide 35 which includes three metal walls 35*a* to 35*c* and has the U shape of which the bottom is open is used. However, the radiation wave guide 35 may have a shape capable of allowing the metal walls to surround one end of the main conductor 12 at a predetermined length, controlling the radiation of the electromagnetic waves to the external space from the boundary between the microstrip line 10 and the transmission line 31 filled with the dielectric material 33, and guiding the radiation waves radiated to the external space toward the other end of the main conductor 12, or may have an inner section having a trapezoidal or semicircular shape. The groove 37 may be formed in the entire inner circumference at a predetermined depth in addition to a wall surface facing the dielectric substrate 11 of the microstrip line 10.

Meanwhile, when the width a of the transmission line 31 is 2.2 mm according to the numerical value example and the height b is the same (1.55 mm) as the height of the transmission line 21 of the waveguide 20, the thickness of the second dielectric layer (air layer) 134 is 1.25 mm which is obtained by subtracting 0.3 mm which is the thickness of the first dielectric layer 133 from 1.55 mm. In this case, since there is not a great difference between 2.2×1.55 mm which is the sectional size of the transmission line 31 and about 3.1×1.55 mm which is the standard sectional size of the WR-12 waveguide used in the millimeter-wave band, it is estimated that the reflection will not greatly occur even in a directly connected state.

However, in the numerical value example, the thickness of the second dielectric layer 134 is four or more times greater than the thickness of the first dielectric layer 133, and the height of the line at the boundary between the microstrip line 10 and the transmission line is greatly changed. Thus, there is a possibility that the reflection may occur.

Thus, in the present embodiment, by setting the thickness of the second dielectric layer 134 to be substantially the same as the thickness of the first dielectric layer 133, an extreme difference does not occur between the thickness of the microstrip line 10 and the height dimension of the transmission line 31.

As a result, since the height dimension of the transmission line 31 is necessarily less than the standard height dimension of the transmission line of the WR-12 waveguide, there is a problem of a difference between the sectional sizes of the transmission line and the waveguide 20 at this time.

For this reason, as shown in FIG. 9, the reflection due to the difference between the sectional sizes of the transmission line 31 and the waveguide 20 is controlled by setting the sectional size of the aperture 21*a* at the one end of the waveguide 20' to be the size (for example, 2.2×0.6 mm) which is less than the standard sectional size and corresponds to the sectional size of the other end of the transmission line 31 and forming a taper portion 21*b* of which the sectional size gradually (although the sectional size straightly increases in the drawing, the sectional size may stepwisely increase) increases (for example, up to the standard sectional size) toward the other end from the aperture and a standard sectional size portion 21*c* that is continuously connected to the portion 21*b*.

Figure 10:
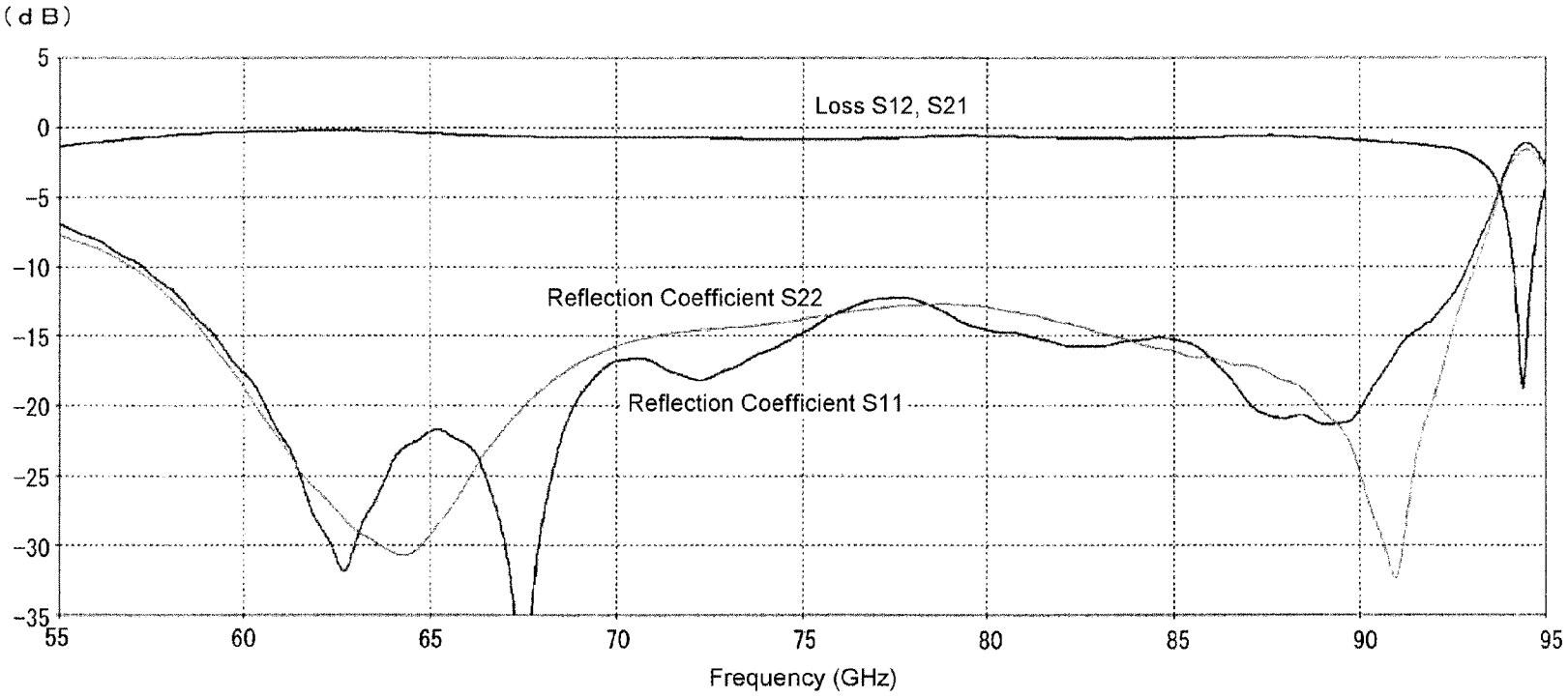
FIG. 10 is a diagram showing a simulation result of the structure of FIG. 9.

A simulation result in which transmission characteristics when the numerical value example is used are obtained in the transmission-line conversion structure shown in FIG. 9 is shown in FIG. 10.

It can be seen in FIG. 10 that an insertion loss is 1 dB or less and a reflection coefficient is −10 dB or less in a frequency range of 60 to 90 GHz and the matching between the microstrip line 10 and the waveguide 20 is achieved in a wide frequency range of the millimeter-wave band.

Figure 11:
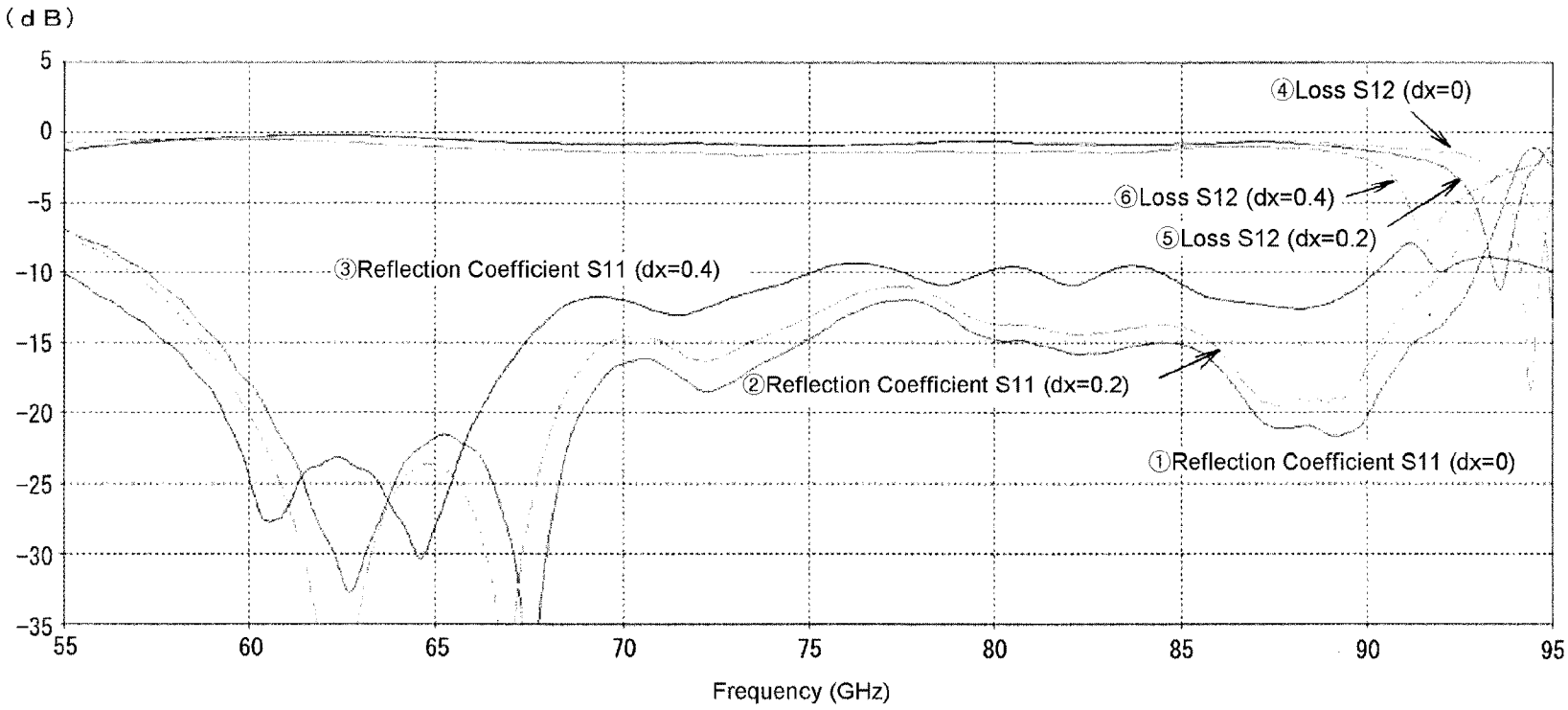
FIG. 11 is a diagram showing a simulation result when a microstrip line deviates in an X direction in the structure of FIG. 9.
Figure 12:
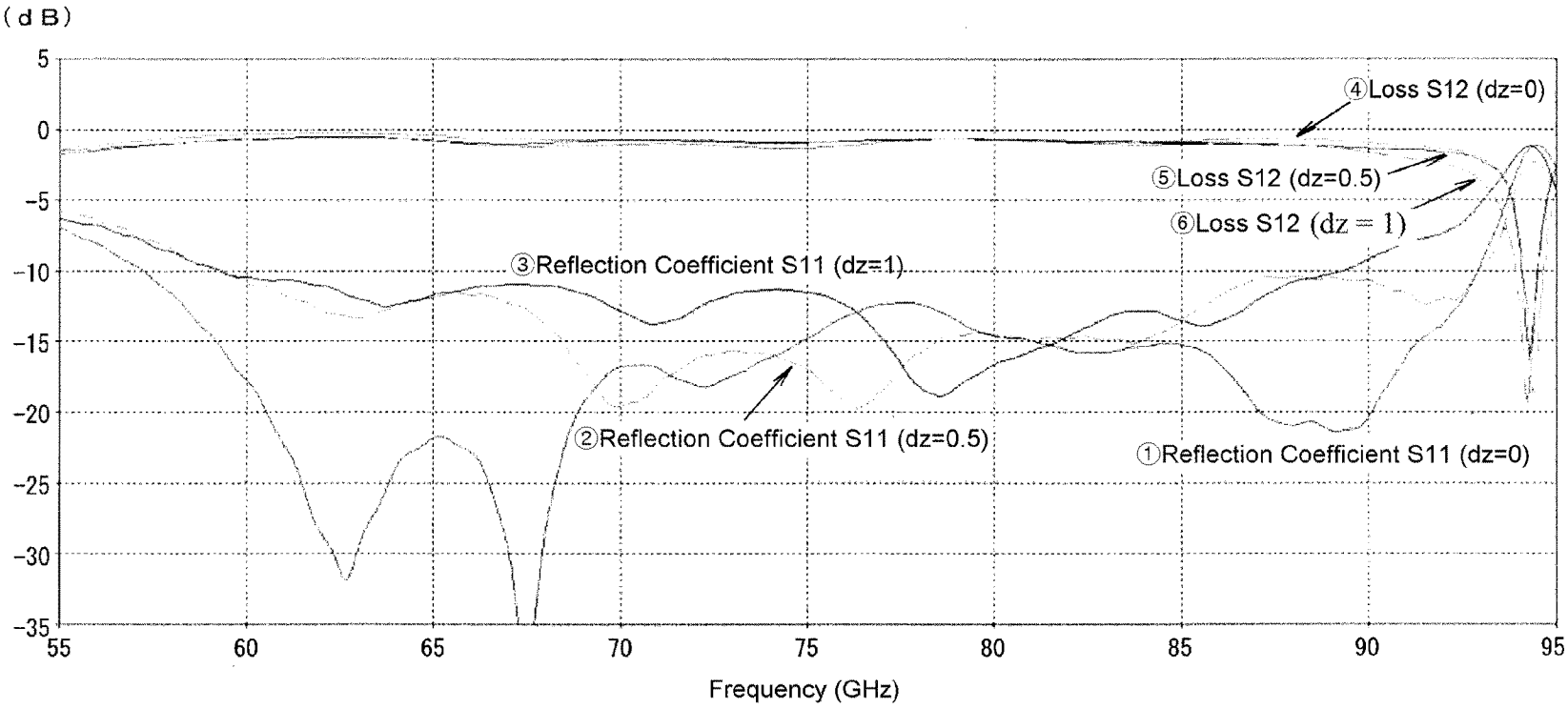
FIG. 12 is a diagram showing a simulation result when the microstrip line deviates in a Z direction in the structure of FIG. 9.

FIG. 11 shows a case where transmission characteristics when the position of the microstrip line 10 deviates from the transmission line 31 in a direction (X direction) perpendicular to the longitudinal direction (Z direction) of the main conductor 12 on a surface (X-Z plane) parallel to the dielectric substrate 11 (movement amount is dx) are obtained, and FIG. 12 shows a case where transmission characteristics when the position of the microstrip line 10 deviates from the transmission line 31 in the longitudinal direction (Z direction) of the main conductor 12 on the surface parallel to the dielectric substrate 11 (movement amount is dz) are obtained.

It can be seen from FIGS. 11 and 12 that a reflection coefficient S11 is −10 dB or less even though the microstrip line deviates by about 0.2 mm in the X direction and performance is ensured even though the microstrip line deviates by about 0.5 mm in the Z direction. Since a general manufacturing error of components having such errors is about ±10 μm and an error is 100 μm or less even in the assembly of the components, the aforementioned conversion structure is capable of maintaining desired performance in the error of the component or the assembly.

Although it has been described in the transmission-line conversion structure that the plurality of dielectric layers are formed on the transmission line 31 formed so as to surround the metal walls 32*a* to 32*d*, the transmission line 31 may have any structure.

Figure 13:
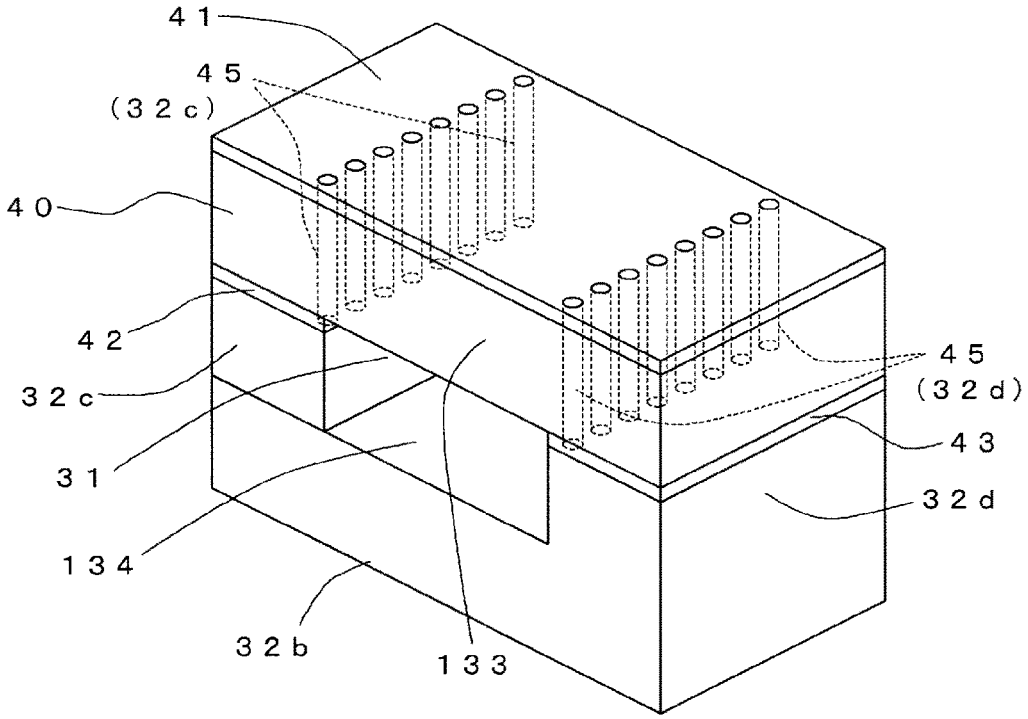
FIG. 13 is a diagram showing an example in which a metal wall that surrounds a transmission line is formed using metal posts.
Figure 14:
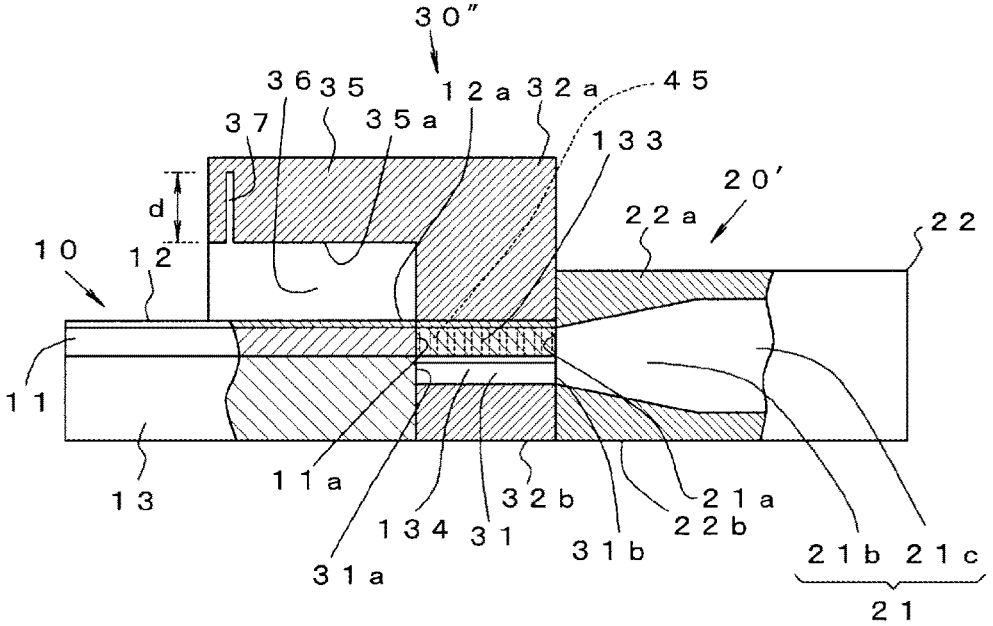
FIG. 14 is a diagram showing a structure using the transmission line of FIG. 13.

For example, as shown in FIG. 13, it is possible to form a part of the metal walls 32*c* and 32*d* constituting the transmission line 31 so as to surround both sides of the first dielectric layer 133 by connecting the ground conductor 41 that covers the entire upper surface of the dielectric substrate 40 similar to the dielectric substrate 11 used in the microstrip line 10 and the ground conductors 42 and 43 that cover both ends on the lower surface by using metal posts 45 formed through through-hole processing and forming the metal posts 45 in two rows with a predetermined distance. In this case, the distance between the metal posts 45 within the row is sufficiently less than the wavelength of the electromagnetic waves propagating through the first dielectric layer 133, and the distance between the rows is equal to the aforementioned width a. FIG. 14 shows a transmission-line conversion structure in which the transmission line 31 is formed using the metal posts 45, and in this case, the ground conductor 41 of the dielectric substrate 40 is in contact with the metal wall 32*a*, and the ground conductors 42 and 43 are in contact with the metal walls 32*c* and 32*d*.

Since the thickness of the ground conductor 41 is generally small enough to be ignored compared with the thickness of the substrate, even though the central portion (portion between the rows of the metal posts 45) of the ground conductor 41 is removed, the metal wall 32*a* is in contact with the top of the ground conductor, and thus, there is no difficulty.

Figure 15:
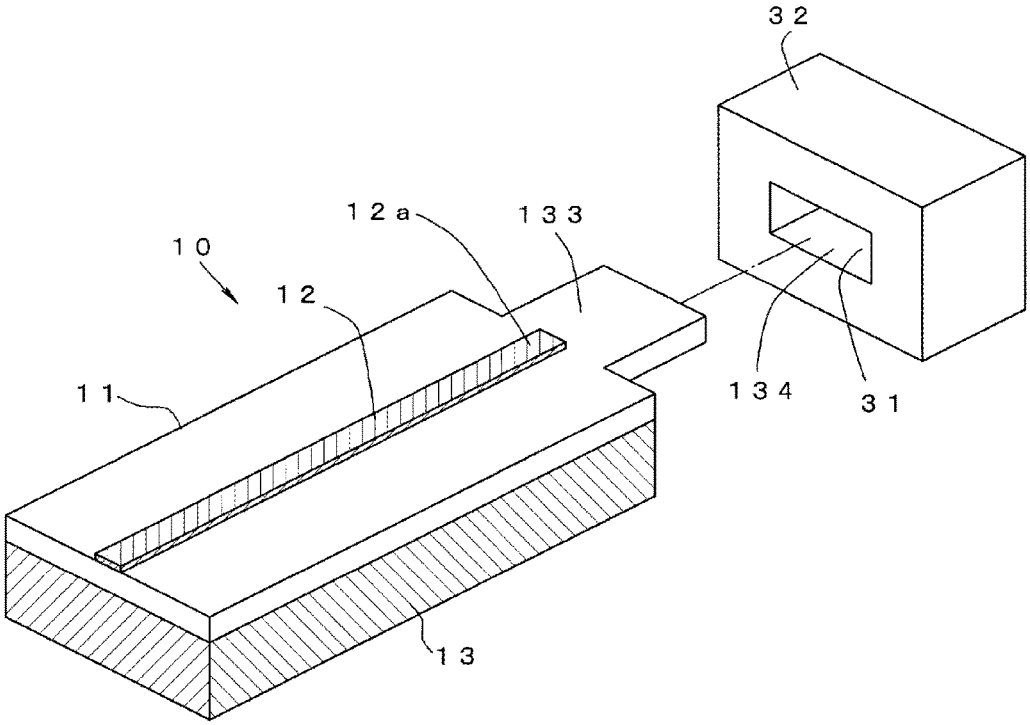
FIG. 15 is a diagram showing a structure example in which one of dielectric layers is formed by extending a dielectric substrate of the microstrip line.
Figure 16:
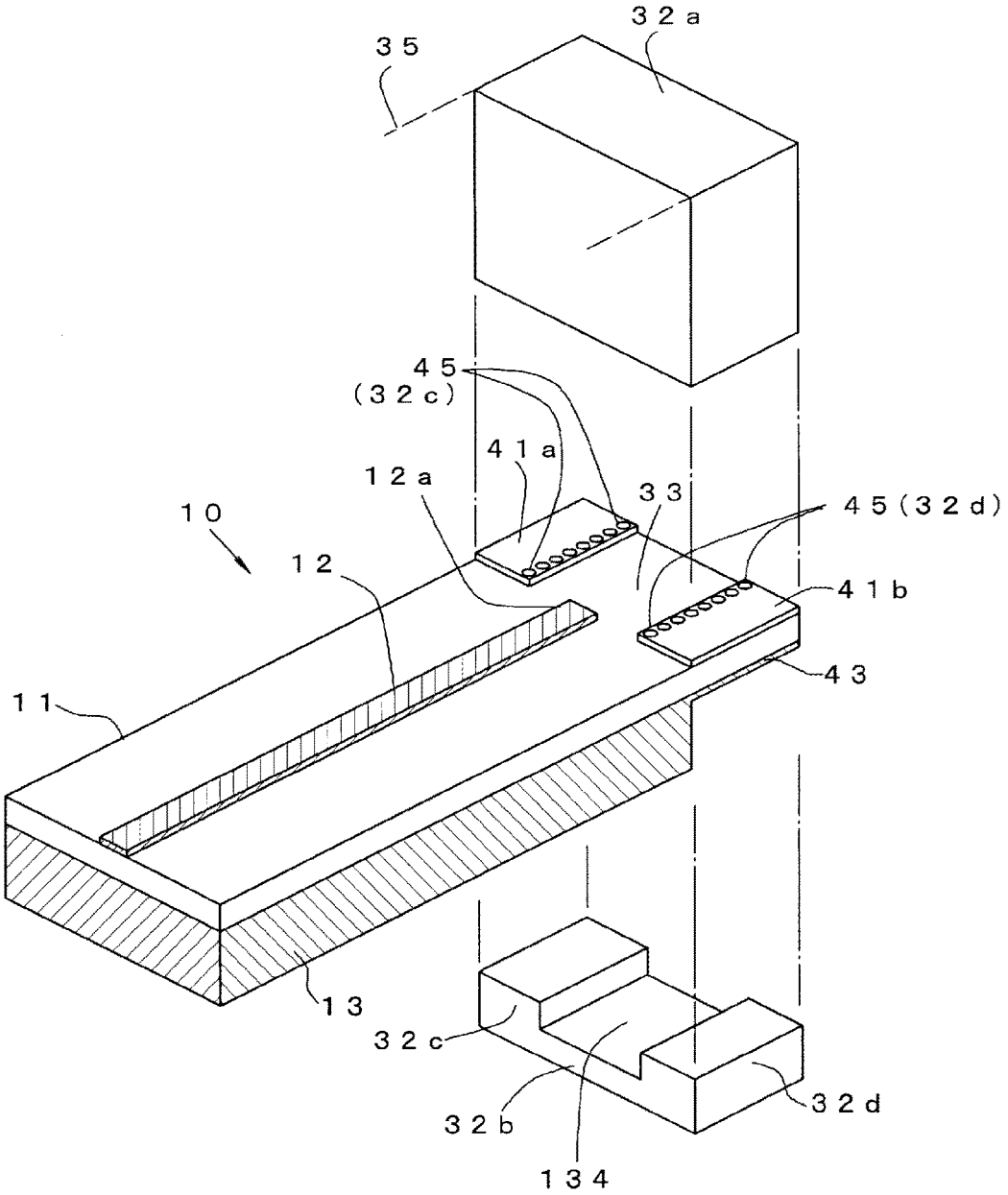
FIG. 16 is a diagram showing another structure example in which one of dielectric layers is formed by extending the dielectric substrate of the microstrip line.

Although it has been described in the respective embodiments that the transmission line converter 30 including the transmission line 31 on which the plurality of dielectric layers is formed is provided separately from the microstrip line 10 and the waveguide 20 or 20', the first dielectric layer 133 may be formed by extending the end of the dielectric substrate 11 of the microstrip line 10, as shown in FIGS. 15 and 16. FIG. 15 shows a structure corresponding to the structure shown in FIGS. 8 and 9, and FIG. 16 shows a structure corresponding to the structure using the metal posts 45 of FIGS. 13 and 14. Similarly to the lower surface, the ground conductor 41 on the upper surface of FIGS. 13 and 14 is divided into two ground conductors 41*a* and 41*b*, and the ground conductor 13 of the microstrip line 10 extends so as to serve as the ground conductors 42 and 43 of FIGS. 13 and 14.

Although not shown, it is possible to integrally form at least a part of the metal walls 32*a* to 32*d* constituting the transmission line 31 with the ground conductor 13 of the microstrip line 10 or the metal walls of the waveguide 20 or 20', and it is possible to variously modify the specific structure. For example, various structures such as a structure in which the metal wall 32*b* constituting the transmission line 31 extends toward the microstrip line 10 so as to serve as the ground conductor 13 supporting the dielectric substrate 11 and extends toward the waveguide 20 so as to serve as the lower metal wall of the waveguide 20 may be adopted.

Although it has been described in the aforementioned embodiment that the number (M) of dielectric layers is 2 and one of the dielectric layers is an air layer, a dielectric layer other than air may be used, or the number (M) of dielectric layers may be 3 or more. Although it has been described in the aforementioned example that one of the plurality of dielectric layers formed on the transmission line is made of the same material as the dielectric substrate of the microstrip line 10 and has the same thickness as the dielectric substrate, the transmission line may be formed using a dielectric layer which is made of a material different from the dielectric substrate of the microstrip line 10 and has an arbitrary thickness.

DESCRIPTION OF REFERENCE NUMERALS AND SIGNS

10 . . . Microstrip line
11 . . . Dielectric substrate
12 . . . Main conductor
13 . . . Ground conductor
20, 20' . . . Waveguide
21 . . . Transmission line
30, 30', 30" . . . Transmission line converter
31 . . . Transmission line
32 . . . Metal wall
33 . . . Dielectric material
35 . . . Radiation wave guide
35*a* . . . First wall
35*b* . . . Second wall
35*c* . . . Third wall
36 . . . Radiation wave guide path
37 . . . Groove
40 . . . Dielectric substrate
41, 42, 43 . . . Ground conductor
45 . . . Metal post
133 . . . First dielectric layer
134 . . . Second dielectric layer

What is claimed is:

1. A transmission-line conversion structure for a millimeter-wave band that connects a microstrip line, which includes a main conductor formed on one surface of a dielectric substrate and a ground conductor formed on the other surface thereof and allows electromagnetic waves of a millimeter-wave band to propagate in a longitudinal direction of the main conductor, with a waveguide which allows the electromagnetic waves of the millimeter-wave band to propagate, wherein the transmission-line conversion structure has a waveguide structure in which a transmission line having a predetermined length is formed so as to be surrounded by metal walls, the transmission line is filled with a dielectric material having a relative permittivity of greater than 1, one end surface of the transmission line is bonded to an end surface of the dielectric substrate of the microstrip line, and the other end surface of the transmission line is bonded to an aperture of the waveguide, wherein the dielectric material filling the transmission line includes a plurality M of dielectric layers having different relative permittivities, and is formed so as to be continuously connected from one end of the transmission line to the other end thereof, wherein the transmission-line conversion structure is formed between the microstrip line and one end of the transmission line and between the other end of the transmission line and one end of the waveguide so as to allow the electromagnetic waves of the millimeter-wave band to propagate, wherein, impedances of the transmission line with respect to electromagnetic waves having a plurality N (≥M) of different frequencies $f_1$, $f_2$, . . . , and $f_N$ in a desired propagation frequency band are represented as $Z_{x1}$, $Z_{x2}$, . . . , and $Z_{xN}$, impedances of the waveguide are represented as $Z_{w1}$, $Z_{w2}$, . . . , and $Z_{wN}$, and an impedance Z1 of the microstrip line is represented as Z1, the relationships of $Z_{x1}=\sqrt{(Z_1\times Z_{w1})}$, $Z_{x2}=\sqrt{(Z_1\times Z_{w2})}$, . . . , and $Z_{xN}=\sqrt{(Z_1\times Z_{wN})}$ are satisfied, and when the M number of frequencies among frequencies of the plurality N of frequencies $f_1$, $f_2$, . . . , and $f_N$ are $f_{a1}$ to $f_{aM}$, a guide wavelength when the electromagnetic wave having the first frequency $f_{a1}$ propagates through a first dielectric layer of the plurality of dielectric layers is $\lambda_{g1}$, a guide wavelength when the electromagnetic wave having the second frequency $f_{a2}$ propagates through a second dielectric layer of the plurality of dielectric layers is $\lambda_{g2}$ and so on, after $f_{a2}$ and $\lambda_{g2}$, and a guide wavelength when the electromagnetic wave having the M-th frequency $f_{aM}$ propagates through a M-th dielectric layer of the plurality of dielectric layers is $\lambda_{gM}$, a sectional size of the transmission line and relative permittivities of the respective dielectric layers are set such that a length L of the transmission line is represented by $L=\lambda_{g1}/4=\lambda_{g2}/4= \ldots , =\lambda_{gM}/4$.

2. The transmission-line conversion structure for a millimeter-wave band according to claim 1, wherein one of the plurality M of dielectric layers is formed by extending the end of the dielectric substrate of the microstrip line.

3. The transmission-line conversion structure for a millimeter-wave band according to claim 1, wherein metal posts that connect ground conductors formed on both surfaces of the dielectric substrate through through-hole processing are formed in a part of the metal walls that surround the transmission line in rows with a predetermined distance.

4. The transmission-line conversion structure for a millimeter-wave band according to claim 1, wherein a cross-sectional area of the aperture of one end of the waveguide bonded to the other end of the transmission line is set to a size corresponding to a cross-sectional area of the transmission line on which the plurality of dielectric layers is formed, and the cross-sectional area of the aperture of the waveguide increases toward the other end of the waveguide.

5. The transmission-line conversion structure for a millimeter-wave band according to claim 1, wherein the M is 2, the first dielectric layer is a dielectric material having a relative permittivity of greater than 1, and the second dielectric layer is an air layer having a relative permittivity of 1.

6. The transmission-line conversion structure for a millimeter-wave band according to claim 5, further comprising:

a radiation wave guide that forms a radiation wave guide path which surrounds one end of the main conductor of the microstrip line by using metal walls at a predetermined length and guides radiation waves radiated to an external space from a boundary toward the other end of the main conductor, the boundary being between the microstrip line and the transmission line on which the plurality of dielectric layers are formed; and a groove that is formed in an inner circumference of the metal walls of the radiation wave guide so as to have a depth corresponding to a quarter of a wavelength of the desired propagation frequency in order to prevent the leakage of the radiation waves.

7. The transmission-line conversion structure for a millimeter-wave band according to claim 1, further comprising:

a radiation wave guide that forms a radiation wave guide path which surrounds one end of the main conductor of the microstrip line by using metal walls at a predetermined length and guides radiation waves radiated to an external space from a boundary toward the other end of the main conductor, the boundary being between the microstrip line and the transmission line on which the plurality of dielectric layers are formed; and a groove that is formed in an inner circumference of the metal walls of the radiation wave guide so as to have a depth corresponding to a quarter of a wavelength of the desired propagation frequency in order to prevent the leakage of the radiation waves.

8. A transmission-line conversion structure for a millimeter-wave band that connects a microstrip line, which includes a main conductor formed on one surface of a dielectric substrate and a ground conductor formed on the other surface thereof and allows electromagnetic waves of a millimeter-wave band to propagate in a longitudinal direction of the main conductor, with a waveguide which allows the electromagnetic waves of the millimeter-wave band to propagate, wherein the transmission-line conversion structure has a waveguide structure in which a transmission line having a predetermined length is formed so as to be surrounded by metal walls, the transmission line is filled with a dielectric material having a relative permittivity of greater than 1, one end surface of the transmission line is bonded to an end surface of the dielectric substrate of the microstrip line, and the other end surface of the transmission line is bonded to an aperture of the waveguide, wherein the dielectric material filling the transmission line includes a plurality M of dielectric layers having different relative permittivities, and is formed so as to be continuously connected from one end of the transmission line to the other end thereof, and wherein the M is 2, a first dielectric layer is a dielectric material having a relative permittivity of greater than 1, and a second dielectric layer is an air layer having a relative permittivity of 1.

9. The transmission-line conversion structure for a millimeter-wave band according to claim 8, wherein a cross-sectional area of the aperture of one end of the waveguide bonded to the other end of the transmission line is set to a size corresponding to a cross-sectional area of the transmission line on which the plurality of dielectric layers is formed, and the cross-sectional area of the aperture of the waveguide increases toward the other end of the waveguide.

10. The transmission-line conversion structure for a millimeter-wave band according to claim 8, wherein the transmission-line conversion structure is formed between the microstrip line and one end of the transmission line and between the other end of the transmission line and one end of the waveguide so as to allow the electromagnetic waves of the millimeter-wave band to propagate.

11. A transmission-line conversion structure for a millimeter-wave band that connects a microstrip line, which includes a main conductor formed on one surface of a dielectric substrate and a ground conductor formed on the other surface thereof and allows electromagnetic waves of a millimeter-wave band to propagate in a longitudinal direction of the main conductor, with a waveguide which allows the electromagnetic waves of the millimeter-wave band to propagate, wherein the transmission-line conversion structure has a waveguide structure in which a transmission line having a predetermined length is formed so as to be surrounded by metal walls, the transmission line is filled with a dielectric material having a relative permittivity of greater than 1, one end surface of the transmission line is bonded to an end surface of the dielectric substrate of the microstrip line, and the other end surface of the transmission line is bonded to an aperture of the waveguide, wherein the dielectric material filling the transmission line includes a plurality M of dielectric layers having different relative permittivities, and is formed so as to be continuously connected from one end of the transmission line to the other end thereof, wherein the transmission-line conversion structure is formed between the microstrip line and one end of the transmission line and between the other end of the transmission line and one end of the waveguide so as to allow the electromagnetic waves of the millimeter-wave band to propagate, and further comprising:

a radiation wave guide that forms a radiation wave guide path which surrounds one end of the main conductor of the microstrip line by using metal walls at a predetermined length and guides radiation waves radiated to an external space from a boundary toward the other end of the main conductor, the boundary being between the microstrip line and the transmission line on which the plurality of dielectric layers are formed; and a groove that is formed in an inner circumference of the metal walls of the radiation wave guide so as to have a depth corresponding to a quarter of a wavelength of the desired propagation frequency in order to prevent the leakage of the radiation waves.

12. The transmission-line conversion structure for a millimeter-wave band according to claim 11, wherein a cross-sectional area of the aperture of one end of the waveguide bonded to the other end of the transmission line is set to a size corresponding to a cross-sectional area of the transmission line on which the plurality of dielectric layers is formed, and the cross-sectional area of the aperture of the waveguide increases toward the other end of the waveguide.

* * * * *